US006889850B2

(12) United States Patent
Amari et al.

(10) Patent No.: US 6,889,850 B2
(45) Date of Patent: May 10, 2005

(54) BILL PROCESSING DEVICE

(75) Inventors: Isao Amari, Kofu (JP); Hidetoshi Kobayashi, Kofu (JP); Kenji Ozawa, Kofu (JP); Hiroyuki Oiyama, Kofu (JP)

(73) Assignee: Japan Cash Machine Co., Ltd., Osaka (JP)

( * ) Notice: Subject to any disclaimer, the term of this patent is extended or adjusted under 35 U.S.C. 154(b) by 38 days.

(21) Appl. No.: 10/088,423

(22) PCT Filed: Jul. 17, 2001

(86) PCT No.: PCT/JP01/06169

§ 371 (c)(1),
(2), (4) Date: Jul. 1, 2002

(87) PCT Pub. No.: WO02/07108

PCT Pub. Date: Jan. 24, 2002

(65) Prior Publication Data

US 2002/0180136 A1 Dec. 5, 2002

(30) Foreign Application Priority Data

| | | |
|---|---|---|
| Jul. 17, 2000 | (JP) | 2000-216522 |
| Nov. 13, 2000 | (JP) | 2000-345842 |
| Nov. 13, 2000 | (JP) | 2000-345843 |
| Nov. 13, 2000 | (JP) | 2000-345844 |

(51) Int. Cl.[7] ..... B07C 5/00
(52) U.S. Cl. ..... 209/534; 902/13
(58) Field of Search ..... 209/534; 902/12, 902/13, 14; 194/206, 207

(56) References Cited

U.S. PATENT DOCUMENTS

| | | | | |
|---|---|---|---|---|
| 4,017,004 A | * | 4/1977 | Onoe et al. | 221/94 |
| 4,428,501 A | * | 1/1984 | Osako | 221/13 |
| 4,524,268 A | * | 6/1985 | Fukatsu | 235/379 |
| 4,549,661 A | * | 10/1985 | Morishita et al. | 209/534 |
| 6,036,089 A | * | 3/2000 | Oguchi et al. | 235/379 |
| 6,109,522 A | * | 8/2000 | Force et al. | 235/379 |
| 6,516,998 B2 | * | 2/2003 | Calder et al. | 235/381 |
| 6,540,136 B1 | * | 4/2003 | Ross | 235/379 |

FOREIGN PATENT DOCUMENTS

| | | |
|---|---|---|
| JP | 4-360299 | 12/1992 |
| JP | 11-120413 | 4/1999 |
| JP | 2000-57406 | 2/2000 |

* cited by examiner

*Primary Examiner*—Donald P. Walsh
*Assistant Examiner*—Joseph Rodriguez
(74) *Attorney, Agent, or Firm*—Gerald E. Hespos; Anthony J. Casella

(57) ABSTRACT

A bill handling apparatus has a deposit/withdrawal unit (2) at the inner upper side of a casing (1), a base unit (3) at the inner lower side of the casing (1), and intermediate units (4A–4C) between the units (2) and (3). The deposit/withdrawal unit (2) includes a bill introducing mechanism (21), a bill discharging mechanism (23) and a conveying mechanism (29). The base unit (3) includes a bill storage section (31), a conveying mechanism (32) and a taking-in and taking-out mechanism (34). Each of the intermediate units (4A–4C) includes a bill storage section (41), a conveying mechanism (42), a taking-in and taking-out mechanism (44) and a switcher for switching a bill-moving direction. In this way, the elements forming the bill storage sections and transfer mechanisms are made common, the number of bill storage sections can be increased or decreased easily, and bills can be taken in and out of each storage section.

6 Claims, 31 Drawing Sheets

BILL PROCESSING DEVICE

TECHNICAL FIELD

This invention relates to a bill handling apparatus capable of taking a plurality of kinds of bills in and storing and dispensing the bills according to the kinds of the bills.

BACKGROUND ART

In various applications of automatic vending machines, game medium lending machines, ticket machines, money-exchanging machines and like machines, various bill handling apparatuses capable of taking a plurality of kinds of bills in and storing and dispensing the bills according to the kinds of the bills have been conventionally known. For example, an apparatus disclosed in Japanese Unexamined Patent Publication No. 11-175804 is constructed such that an apparatus main unit is integrally provided with three cash boxes for 1000-yen bills, 5000-yen bills and 10000-yen bills; when a bill is inserted through a bill insertion slot, the kind thereof is discriminated by a discriminator and the bill is selectively transferred to any of the cash boxes via a conveyer and the like; and the cash box for 1000-yen bills is provided with a dispense roller, a stacking plate on which bills are stacked, and an elevating mechanism for pushing the stacking plate up to press the uppermost one of the stacked bills against the dispense roller, etc., so that 1000-yen bills can be withdrawn (dispensed from the cash box).

In the prior art apparatus disclosed in the above publication, three stages of bill storage sections (cash boxes) are arranged so as to be applicable to three kinds of bills: 1000-yen bills, 5000-yen bills and 10000-yen bills. However, more bill storage sections are sometimes demanded in order to be applicable to four kinds of bills including 2000-yen bills or to five kinds of bills in the case of export to foreign countries. On the other hand, less bill storage sections are demanded as in the case that it is sufficient for the bill handling apparatus to be applicable to two kinds of bills depending on users and applications. Upon meeting such a demand, it is desirable in terms of rationalization, cost reduction, etc. to enable production of different types of apparatuses having different numbers of bill storage sections while using common elements for the different types of bill handling apparatuses and commonly using sections of production lines therefor.

However, since the respective bill storage sections and the internal mechanisms such as the conveying mechanism are integrally assembled in the apparatus main unit in the prior art apparatus, all of the apparatus main unit, the bill storage sections and the internal mechanisms need to be largely changed in order to change the number of the bill storage sections.

Further, the cash boxes for 5000-yen bills and 10000-yen bills are exclusively for depositing, and only the cash box for 1000-yen bills is provided with the mechanism enabling withdrawal in the above prior art device. In order to provide various functions including an exchanging function and a reverse exchanging function, it is desired to make bills other than 1000-yen bills withdrawable.

In view of the above matters, an object of the present invention is to provide a bill handling apparatus which can easily increase and decrease the number of bill storage sections by a necessary and minimum change by using common elements forming bill storage sections, conveying mechanisms, etc. and can deposit and dispense bills into and from the respective storage sections.

DISCLOSURE OF THE INVENTION

The present invention is directed to a bill handling apparatus comprising a deposit/withdrawal unit and a base unit located at upper and lower sides and one or a plurality of intermediate units located between the deposit/withdrawal unit and the base unit inside a casing having openings for inserting and discharging bills therethrough at an upper part of the front surface thereof, wherein:

the deposit/withdrawal unit includes a bill introducing mechanism having a discriminating device for bills and adapted to introduce the bills through an insertion slot corresponding to the opening for inserting the bills, a bill discharging mechanism for discharging the bills to a discharge slot corresponding to the opening for discharging the bills, and a conveying mechanism which can be driven in forward and reverse directions, one end of which is selectively brought into communication with the bill introducing mechanism and the bill discharging mechanism via a switcher at a rear part of this unit, and the other end of which is adapted to convey the bills along a bill conveyance path extending to a bottom end portion of this unit;

the base unit includes a bill storage section, a conveying mechanism which can be driven in forward and reverse directions and convey the bills within a specified range from the upper end of this unit behind the bill storage section, and a taking-in and taking-out mechanism for the bills which can be driven in forward and reverse directions and enables the bills to be taken in and out between the conveying mechanism and the bill storage section; and each intermediate unit includes a bill storage section, a conveying mechanism which can be driven in forward and reverse directions and convey the bills within a range extending from the upper end to the bottom end of this unit behind the bill storage section, a taking-in and taking-out mechanism for bills which can be driven in forward and reverse directions and enables the bills to be taken in and out between the conveying mechanism and the bill storage section, and a switcher for switching a bill moving direction between the conveying mechanism and the taking-in and taking-out mechanism.

With the bill handling apparatus thus constructed, at the time of deposit, the kind of the bill inserted through the insertion slot is discriminated and sent to the bill storage section specified according to the kind of the bill. On the other hand, at the time of withdrawal, the bill is taken out from the bill storage section according to the designated kind of the bill and sent to the discharge slot. In this way, a plurality of kinds of bills can be stored in the respective bill storage sections according to the kinds of the bills, and the bills can be taken out from any of the bill storage sections.

Upon manufacturing a bill handling apparatus having bill storage sections corresponding to the required number of the kinds of the bills to be handled, the number of the bill storage sections can be easily changed by increasing and decreasing the number of the intermediate unit(s) arranged between the deposit/withdrawal unit and the base unit. In other words, the mechanisms for introducing, discriminating and withdrawing the bills, the respective bill storage sections and the mechanisms for taking the bills in and out of the respective bill storage sections are formed into common units, and the conveying mechanisms are also incorporated into the respective common units. Thus, the bill storage section and the internal mechanism are formed into a commonly usable unit. Therefore, bill handling apparatuses corresponding to various kinds of bills such as two kinds of bills, three kinds of bills and four kinds of bills can be obtained by changing the number of the intermediate units and changing the size of the casing.

BEST MODES FOR CARRYING OUT THE INVENTION

Entire Construction of Bill Handling Apparatus

Figure 1:
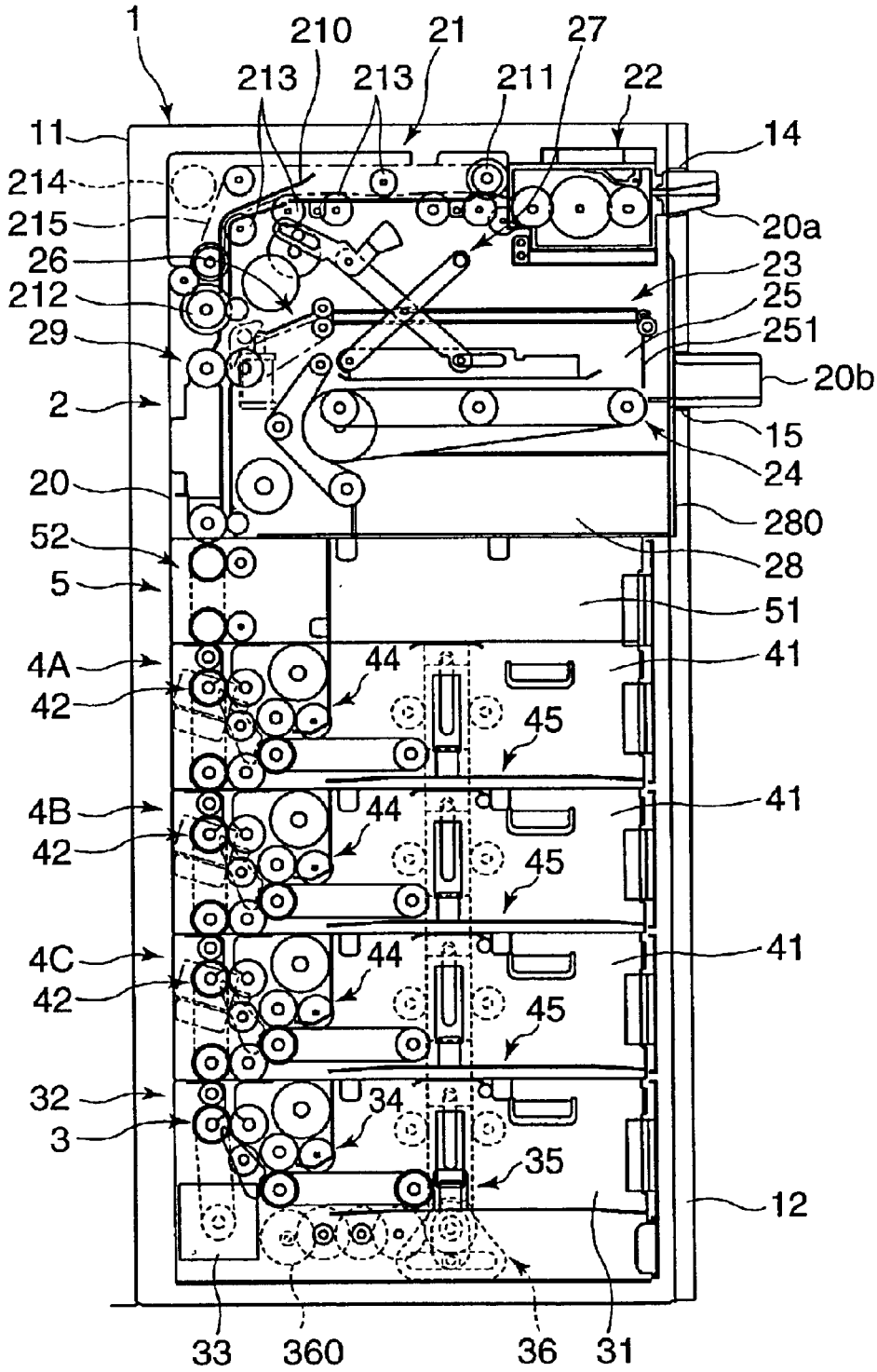
FIG. 1 is a schematic side view in longitudinal section of a bill handling apparatus according to an embodiment of the invention.
Figure 2:
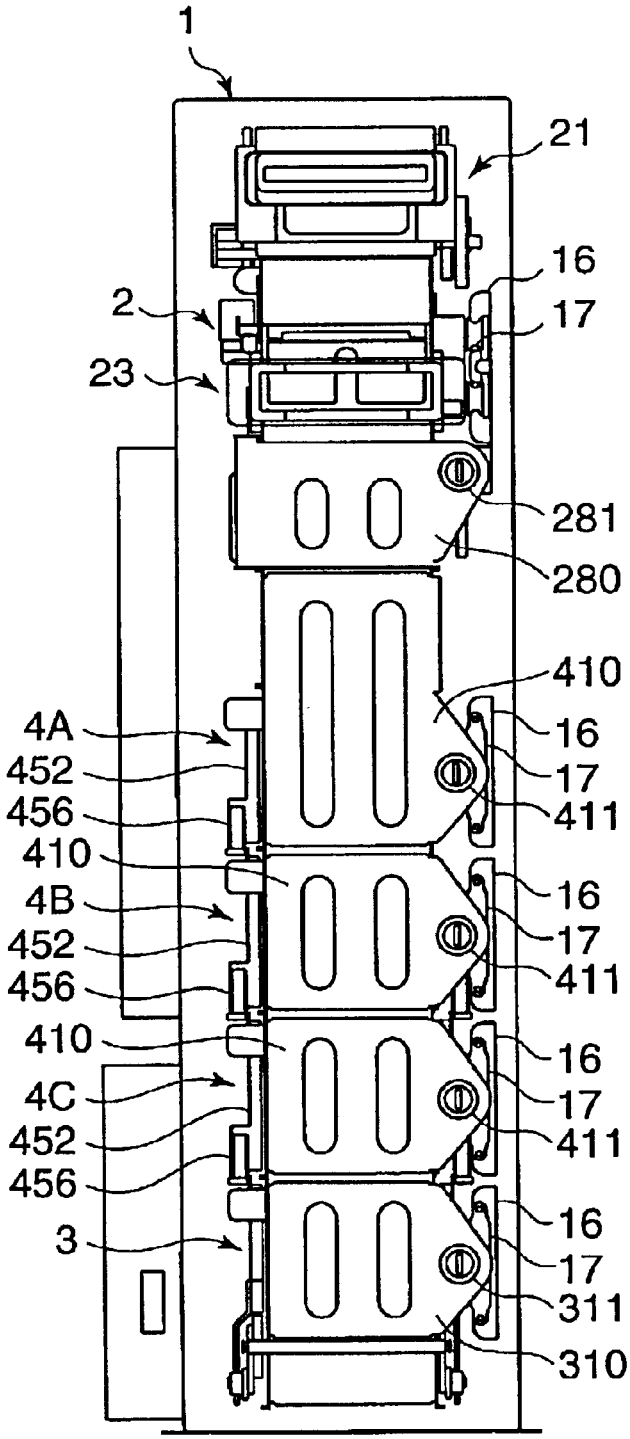
FIG. 2 is a schematic front view in longitudinal section of the bill handling apparatus.
Figure 3:
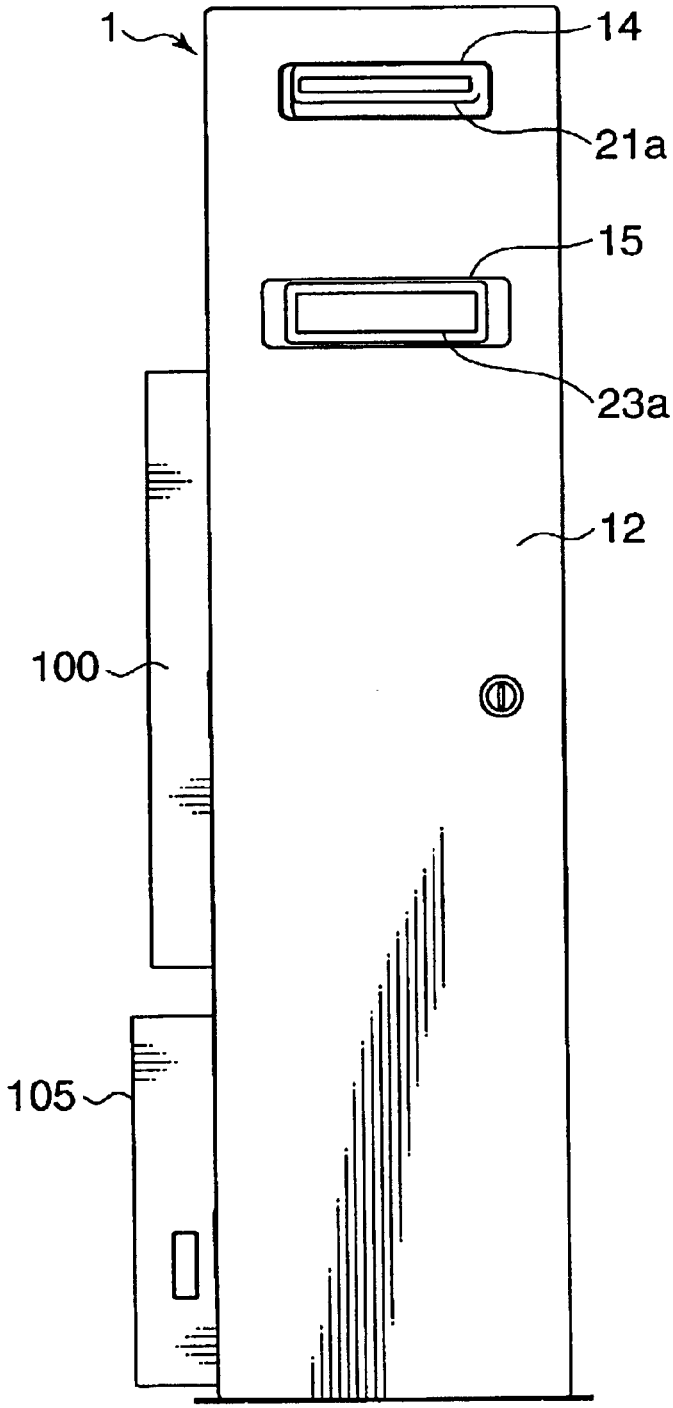
FIG. 3 is a front view showing an external configuration of the bill handling apparatus.
Figure 4:
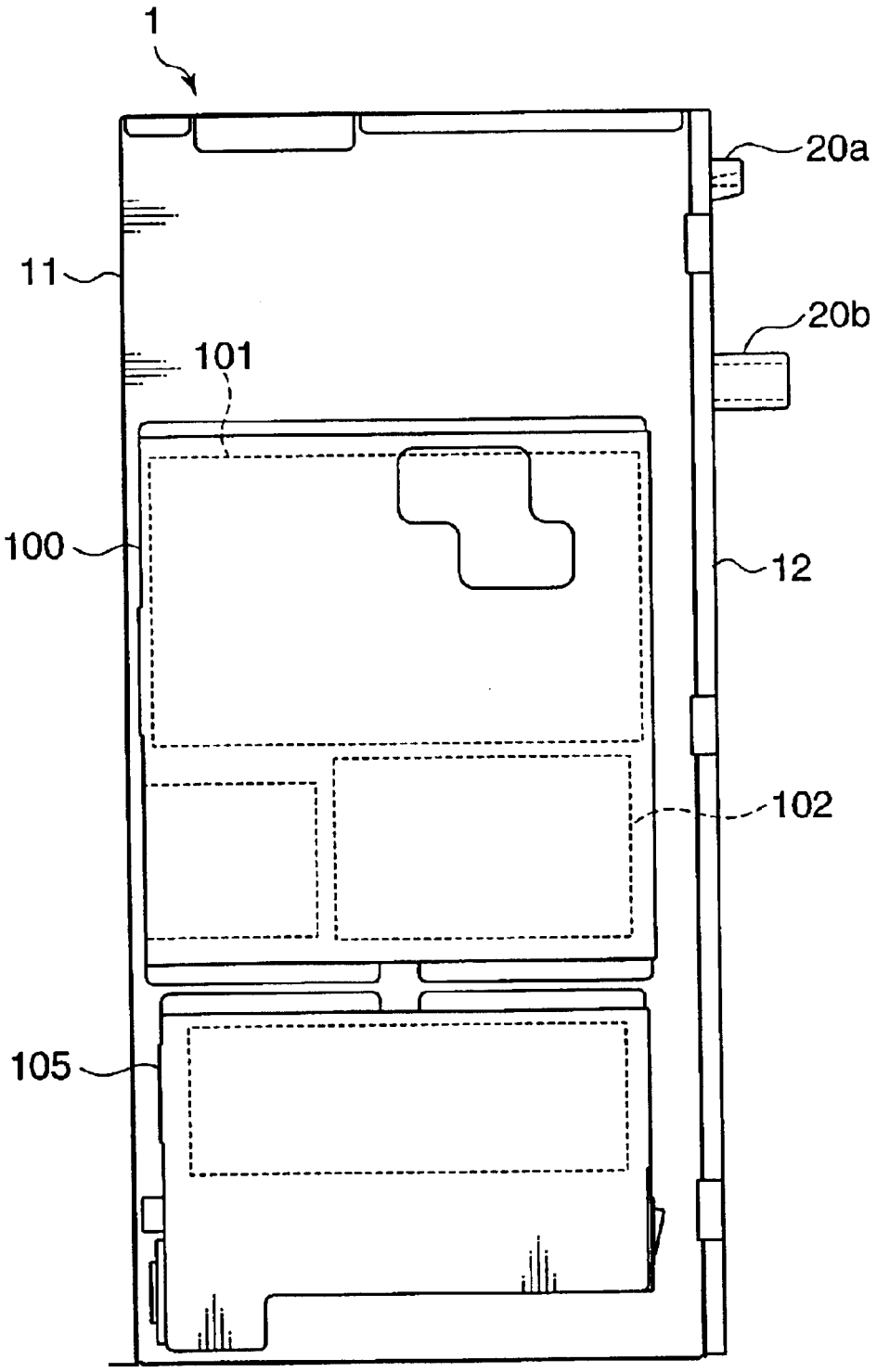
FIG. 4 is a side view showing the external configuration of the bill handling apparatus.

FIGS. 1 and 2 show an internal construction of a bill handling apparatus according to an embodiment of the present invention, and FIGS. 3 and 4 show an external configuration of the bill handling apparatus. In FIGS. 1 to 4, identified by 1 is a casing of the bill handling apparatus. This casing 1 is provided with a box-shaped casing main body 11 having an open front surface and a door 12 for closing the front surface of the casing main body 11, and has a box shape of such a specified size as to accommodate units to be described later. An opening 14 for inserting bills and an opening 15 for dispensing bills are provided at an upper part of the door 12 on the front surface of the casing 1.

Inside the casing 1, a deposit/withdrawal unit 2 located at an uppermost position, a base unit 3 located at a bottommost position, and intermediate units 4A to 4C arranged at one or more stages (three stages in the shown example) are provided between these units 2 and 3. Bills are stored according to the kinds thereof in the respective intermediate units 4A to 4C and in the base unit 3. For example, 1000-yen bills are stored in the unit 4A at the upper stage, 2000-yen bills are stored in the unit 4B at the middle stage, 5000-yen bills are stored in the unit 4C at the lower stag, and 10000-yen bills are stored in the base unit 3.

If necessary, an auxiliary unit 5 for increasing a space for storing bills is provided above one or a plurality of intermediate units. In the shown example, the auxiliary unit 5 is provided above the intermediate unit 4A.

The respective units 2, 3, 4A to 4C are separable from each other and are attachable to and detachable from the casing 1. The respective units 2, 3, 4A to 4C are so supported at one side thereof as to be individually withdrawable forward with respect to the casing 1 by coupling supportable portions 17 provided at one side of the units 2, 3, 4A to 4C to slide guides 16 provided at one side of the casing 1 in such a manner as to be slidable in forward and backward directions. The respective units 2, 3, 4A to 4C are supported on the casing 1 at one side thereof in order to avoid mutual interference of the unit supporting portions, which are provided at the other sides of the units 2, 3, 4A to 4C, with driving force transmitter for transmitting a driving force to conveying mechanisms to be described.

Further, a control board unit 1000 including a main CPU board 101, an auxiliary CPU board 102, etc. and a power supply unit 105 are installed at one side of the casing 1, and the respective units 2, 3, 4A to 4C are electrically connectable with these control board unit 100 and power supply unit 105 via detachable connectors.

Specific constructions of the respective units 2, 3, 4A to 4C are described next.

(Construction of Deposit/Withdrawal Unit)

The deposit/withdrawal unit 2 is constructed such that, in a frame 20 formed with an insertion slot 20*a* and a discharge slot 20*b*, a bill introducing mechanism 21 for introducing bills through the insertion slot 20*a*, a bill discharging mechanism 23 for discharging bills to the discharge slot 20*b*, and a conveying mechanism 29 are provided. The unit 2 is accommodated at an upper inner side of the casing 1 while the insertion slot 20*a* and the discharge slot 20*b* are projecting from the openings 14, 15 of the casing 1.

Figure 13:
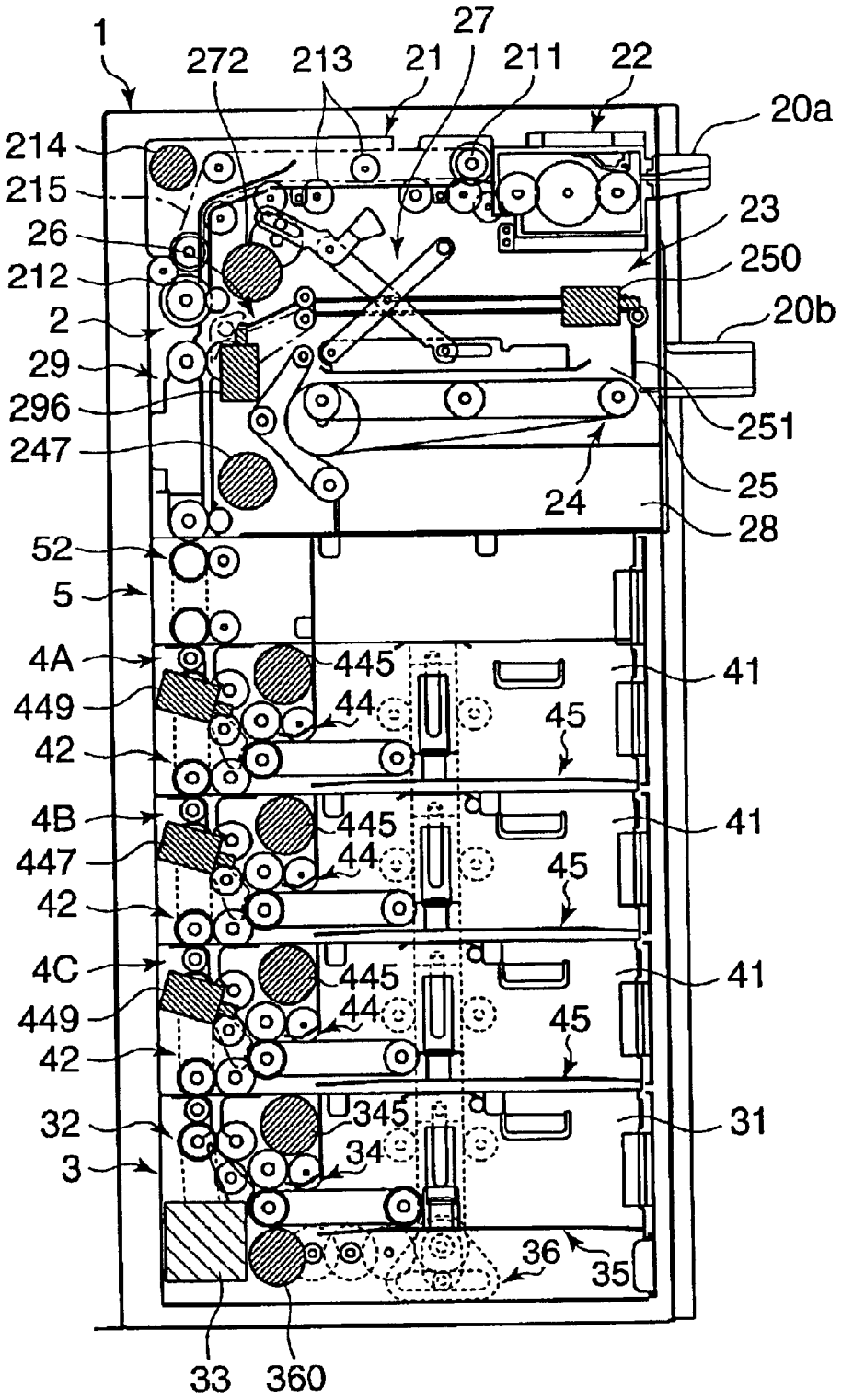
FIG. 13 is a diagram showing actuators provided in the bill handling apparatus.
Figure 14:
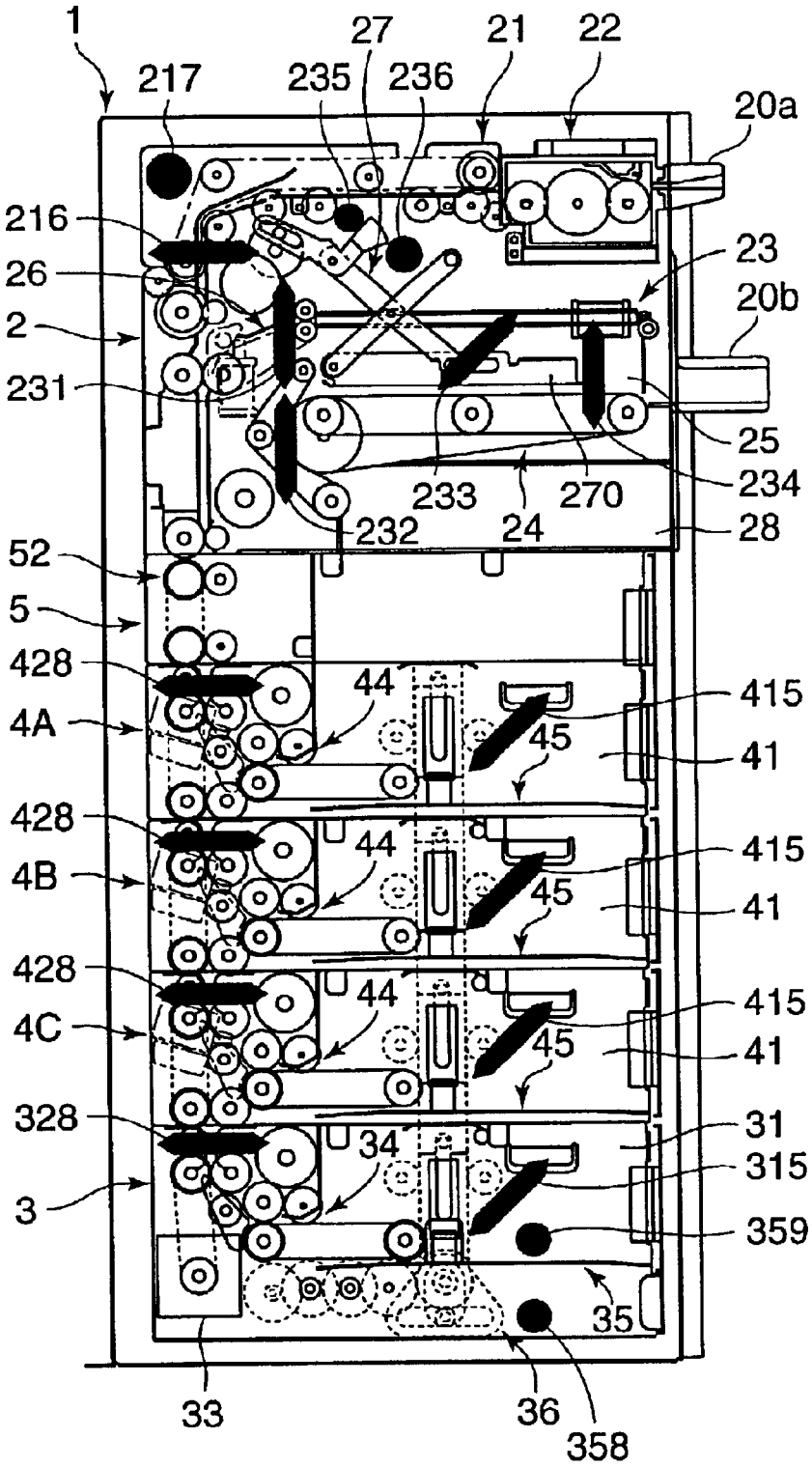
FIG. 14 is a diagram showing sensors provided in the bill handling apparatus.

The bill introducing mechanism 21 includes a discriminating device 22 for discriminating the genuineness and kind of the bill near the insertion slot 20*a*, a bill introducing path 210 for guiding the bill introduced through the insertion slot 20*a* via the discriminating device 22 downward to the back side of the unit 2, feed rollers 211, 212 disposed at upstream and downstream sides of the bill introducing path 210, a guide roller 213 disposed at an intermediate position of the bill introducing path 210, and the like. The rollers 211, 212, 213 are driven by a motor 214 via a transmitting mechanism 215 such as a belt as also shown in FIG. 13. The bill introducing mechanism 21 further includes a sensor 216 for detecting the passage of the bill at a position near the downstream end of the bill introducing path 23, a pulse sensor 217 for detecting the number of rotation of the motor 214, etc. as also shown in FIG. 14.

Figure 5:
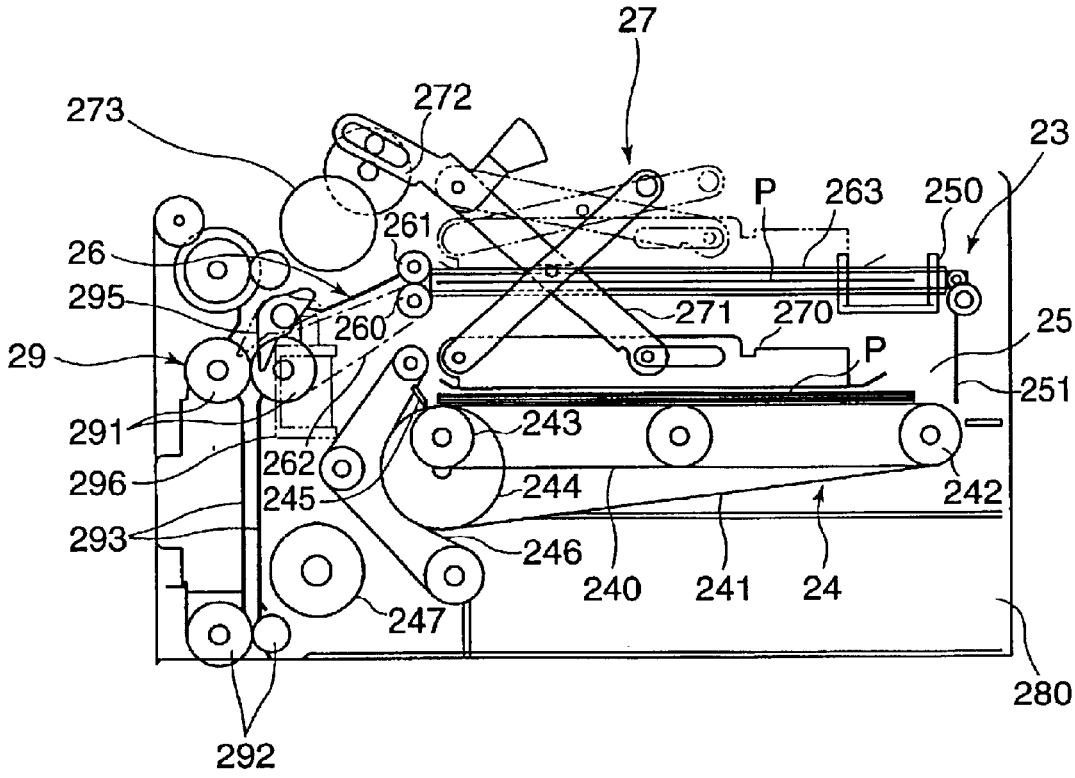
FIG. 5 is a construction diagram showing a bill introducing mechanism and a conveying mechanism of a deposit/withdrawal unit of the bill handling apparatus.

The bill discharging mechanism 23 includes a mechanism for dispensing the bills to the discharge slot 20*b* in response to a withdrawal instruction and a mechanism for rejecting counterfeit bills and the like. As also shown in FIG. 5, the bill discharging mechanism 23 is provided with a feeding belt device 24 disposed at a height position corresponding to the discharge slot 20*b* for rejecting the payout, a temporary storage section 25 formed by a space above the belt device 24, a guiding device 26 for guiding the bill to the temporary storage section 25, a pusher device 27 for stacking the bills in the temporary storage section 25 above the belt device 24, and a rejection chamber 28 formed in a space below the belt device 24.

The belt device 24 includes an endless belt 240 provided at the widthwise center of the deposit/withdrawal unit and endless belts 241 provided at the opposite sides of the endless belt 240. The belt 240 in the middle is mounted between a front pulley 242 and a rear pulley 243 having the same diameter, and the belts 241 at the opposite sides are mounted on the front pulley 242 and a rear large-diameter pulley 244. A projection 245 for pressing the bill is provided for the belt 240 in the middle. Further, for the belts 241 at the opposite sides, an auxiliary belt 246 is so provided as to extend along a specified range of the outer circumference of the rear large-diameter pulley 244.

The belts 240, 241 and the auxiliary belt 246 are driven to be rotatable in forward and reverse directions by a payout rejection motor 247 via an unillustrated transmitter. When these belts are driven in forward direction, the bills temporarily stored on the belts 240, 241 are conveyed toward the discharge slot 20*b* located forward. When these belts are driven in reverse direction, the bills temporarily stored on the belts 240, 241 are conveyed to the rejection chamber 28 located below between the rear large-diameter pulley 244 and the auxiliary belt 246. The front surface of the rejection chamber 28 is made openable by a door 280, which is provided with a lock 281.

A shutter 251 which is opened and closed by a solenoid-type actuator 250 is provided between the temporary storage section 25 and the discharge slot 20*b*.

The guiding device 26 includes a pair of nip rollers 260, 261 disposed above the rear part of the belt device 24, a feed belt 262 mounted between one nip roller 260 and a transport roller to be described later, and a bill temporary holding frame 263 which has a U-shaped cross section and is so arranged as to extend in forward and backward directions at the opposite widthwise ends of the deposit/withdrawal unit 2 at a height position corresponding to the nip rollers 260, 261.

The pusher device 27 includes a pusher member 270 provided above the belt device 24 so as to face the belt device 24, a pantograph-type elevator 271 for suspending the pusher member 270 so as to be movable upward and downward between a raised position (phantom line in FIG. 5) located above the bill temporary holding frame 263 and a lowered position (solid line in FIG. 5) proximate to the belt device 24, and a pusher motor 273 for driving the elevator 271 via a cam member 272.

At the time of dispensing or rejecting, a bill P conveyed by the conveying mechanism 29 via the feed belt 262 and the nip rollers 260, 261 to be temporarily held on the bill temporary holding frame 263 is pushed down by lowering the pusher member 270 from the raised position to be separated from the bill temporary holding frame 263. The pusher member 270 is returned to the raised position after letting the bill P drop onto the belts 240, 241 of the belt device 24. By repeating the above operation, a plurality of bills P are temporarily stored in the temporary storage section 25 on the belts while being stacked one over another.

As also shown in FIG. 14, the bill discharging mechanism 23 further includes a stack-in sensor 231 for detecting the introduction of the bill to the guiding device 26, a rejection sensor 232 for detecting a reflected bill at a rear position of the belt device 24, a remainder sensor 234 for detecting the presence or absence of the bill on the belts of the belt device 24, a discharge sensor for detecting the discharge of the bill to the discharge slot 20*b* from the belts of the belt device 24, and sensors 235, 236 for detecting the upward and downward movements of the pusher member 270, and other sensors.

The conveying mechanism 29 is adapted to convey the bills within a range extending from a position corresponding to the downstream end of the bill introducing path 210 to the bottom end of the deposit/withdrawal unit 2, and includes a pair of upper transport rollers 291, a pair of lower transport rollers 292, and a pair of guide plates 293 opposed to each other between these pairs of rollers. Each pair of rollers are made rotatable together via gears (not shown). The upper and lower rollers 291, 292 are made rotatable together by mounting a transmission belt (not shown) between pulleys provided on shafts of one upper transport roller 291 and one lower transport roller 292.

At the upper end of the conveying mechanism 29 is provided an introduce/discharge switcher provided with a flapper 295. The flapper 295 is driven by a solenoid-type actuator 296 to switch its state between a state where it opens the bill introducing path 210 to the conveying mechanism 29 at the time of deposit (shown in solid line in FIG. 5) and a state where it closes the bill introducing path 210 at the time of withdrawal and rejection, thereby guiding the bill conveyed in reverse direction in the conveying mechanism 29 toward the bill discharging mechanism 23 (shown in phantom line in FIG. 5).

(Constructions of the Base Unit and the Intermediate Units)

Figure 6:
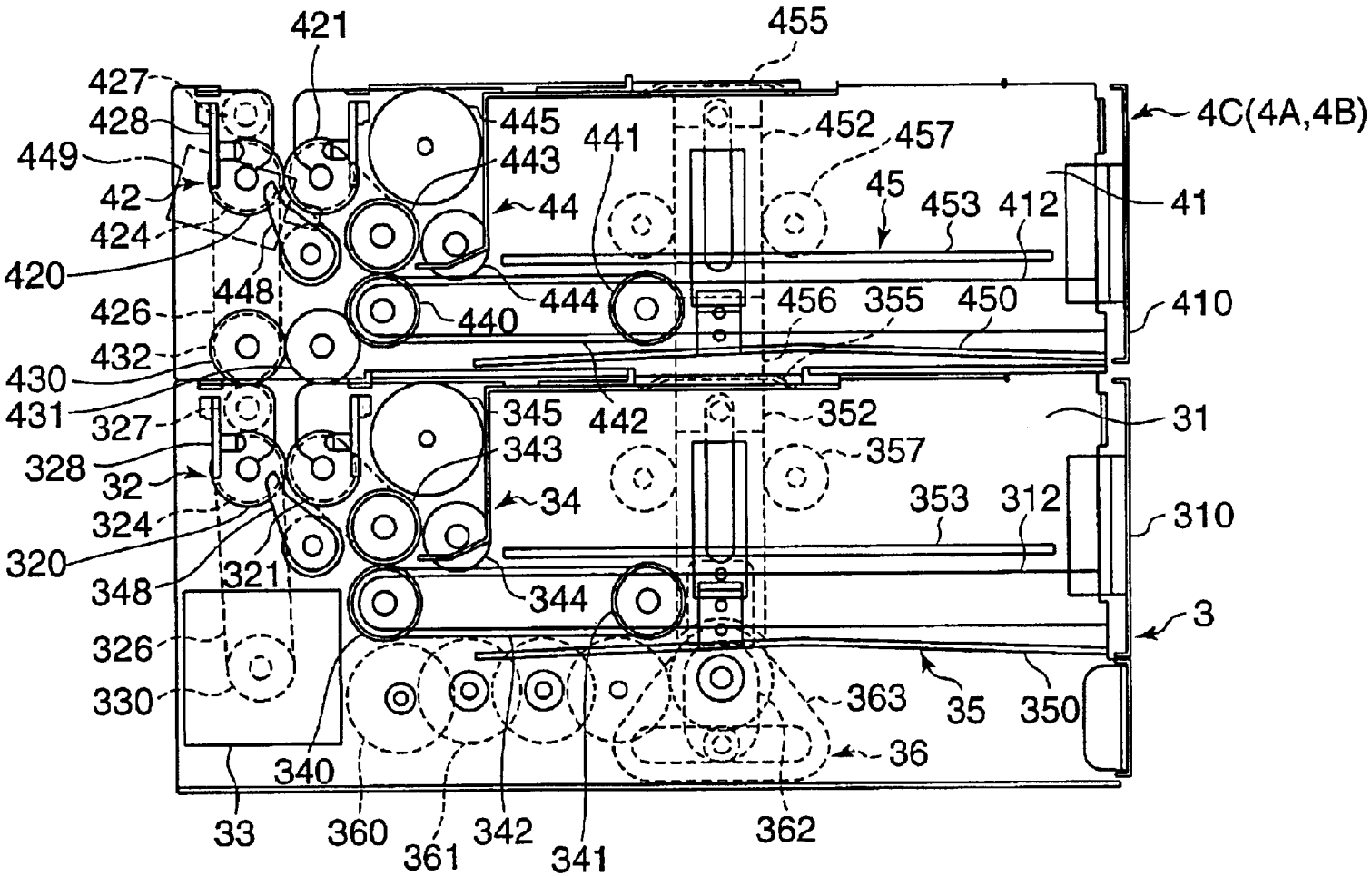
FIG. 6 is a construction diagram showing a base unit and an intermediate unit of the bill handling apparatus.

The base units 3 and the respective intermediate units 4A to 4C are, as shown in FIG. 6, provided with bill storage sections 31, 41, conveying mechanism 32, 42 for vertically conveying the bills behind the bill storage sections 31, 41, taking-in and taking-out mechanisms 34, 44 for taking the bills in and out between the conveying mechanism 32, 42 and the bill storage sections 31, 41, and bill stacking mechanisms 35, 45 for stacking the bills in the bill storage sections 31, 41. The base unit 3 is further provided with a conveyance motor 33 as a driving source of the conveying mechanisms 32, 42, and a driving mechanism 36 for driving the bill stacking mechanisms 35, 45. The auxiliary unit 5 is provided with a storage space expanding portion 51 in communication with the bill storage section 41 of the unit 4A located below the auxiliary unit 5 and a conveying mechanism 52 provided behind the expanding portion 51 (see FIG. 1).

The bill storage section 31 of the base unit 3 and the bill storage sections 41 of the respective intermediate units 4A to 4C have the same construction, and are each formed of opposite side plates, a bottom plate, a door 310, 410 on the front surface, etc. to define an inner space capable of storing the bills in a stacked state. The doors 310, 410 are provided with locks 311, 411. Bill supporting tables 312, 412 are provided at a specified height position in the bill storage sections 31, 41.

(Conveying Mechanism)

Figure 7:
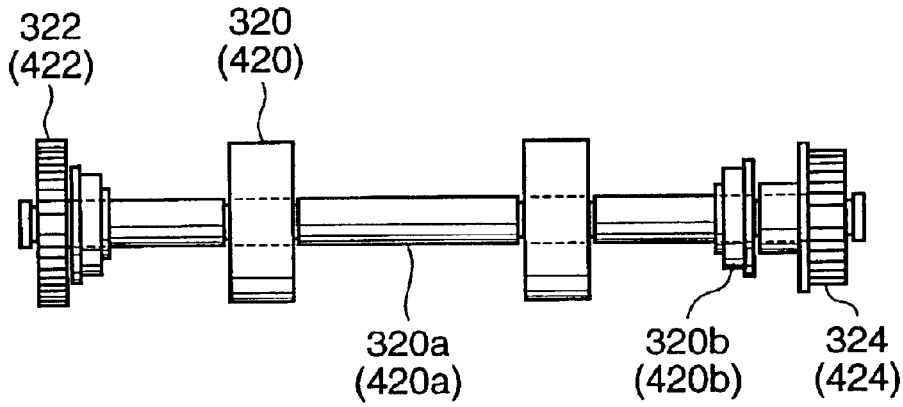
FIG. 7 is a plan view of an assembly of a transport roller shaft.
Figure 8:
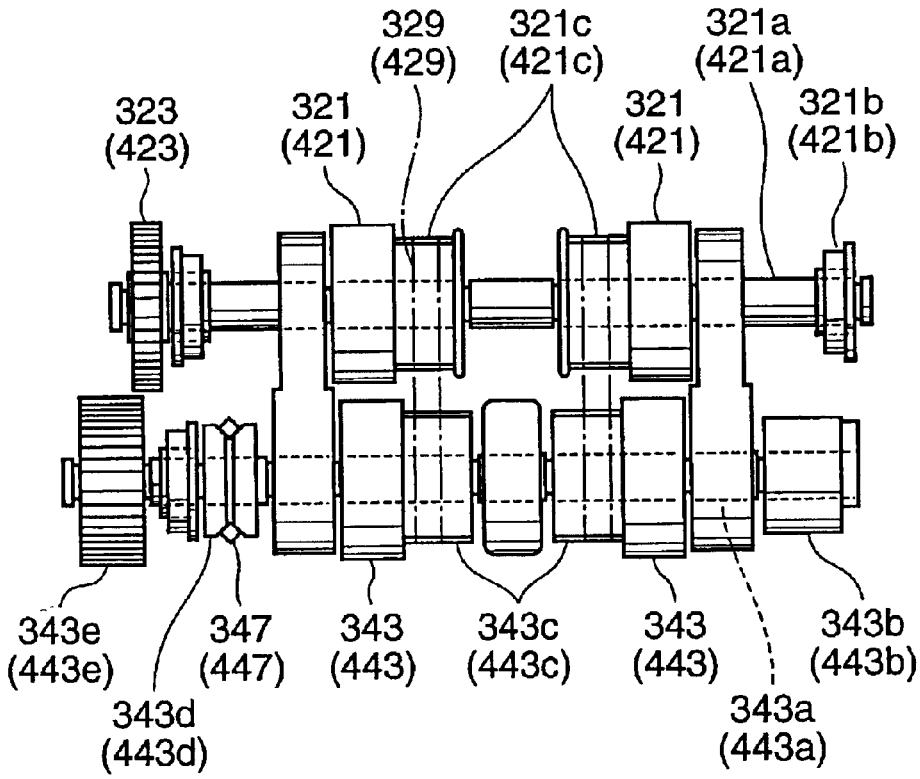
FIG. 8 is a plan view of an assembly including the transport roller shaft and a stopper roller shaft.

The conveying mechanism 32 of the base unit 3 is provided with a pair of transport rollers 320, 321 disposed at an upper part behind the bill storage section 31. One of this pair of transport rollers 320 is incorporated into an assembly of a transport roller shaft 320*a* shown in FIG. 7, and the other roller 321 is incorporated into an assembly including a transport roller shaft 321*a* and a stop roller shaft 343*a* to be described later shown in FIG. 8. As shown in FIGS. 7 and 8, the transport rollers 320, 321 and gears 322, 323 engageable with each other are mounted on the transport roller shafts 320*a*, 321*a* rotatably supported on a frame section of the unit via bearings 320*b*, 321*b*. Further, a pulley 324 is mounted on one transport roller shaft 320*a*. A driving force of the motor 33 is transmitted to both transport rollers 320, 321 by coupling the pulley 324 to a pulley 330 mounted on an output shaft of the conveyance motor 33 via a transmission belt 326 (see FIG. 6).

An intermediate gear 327 for transmitting the driving force to the unit 4C located above the base unit 3 is in mesh with the gear 322 (see FIG. 6). This intermediate gear 327 is located at the upper end of the unit 3. Further, a pulley 321*c* for transmitting the driving force to the stop roller shaft 343*a* via a belt 329 is mounted on the other transport roller shaft 321*a* (see FIG. 8).

The conveying mechanism 42 of each intermediate unit 4A to 4C is, as shown in FIG. 6, provided with a pair of upper transport rollers 420, 421 and a pair of lower transport rollers 430, 431. The upper transport rollers 420, 421 are mounted similar to the transport rollers 320, 321 of the base unit 3 as shown in FIGS. 7 and 8. In other words, the transport rollers 420, 421 and gears 422, 423 engageable with each other are mounted on transport roller shafts 420*a*, 421*a* rotatably supported on a frame section of the unit. A pulley 424 is mounted on one transport roller shaft 420*a*, whereas a pulley 421*c* for transmitting the driving force to a stop roller shaft 443*a* via a belt 429 is mounted on the other transport roller shaft 421*a*.

Gears (not shown) engageable with each other are mounted on transport roller shafts bearing the pair of lower transport rollers 430, 431, and a pulley 432 is mounted on one of these transport roller shaft (see FIG. 6). The lower transport rollers 430, 431 and the upper transport rollers 420, 421 are made rotatable together by mounting a transmission belt 426 between the pulley 432 and the pulley 424 mounted on the upper transport roller shaft 420*a*. Further, an intermediate transmission gear 427 in mesh with the gear 422 mounted on one upper transport roller shaft 420*a* is disposed at the upper end of the unit, whereas the gear 432 mounted on one lower transport roller shaft is engaged with the intermediate transmission gear 327 or 427 provided in the unit immediately below to enable the transmission of the driving force from the lower unit to the conveying mechanism 42 of this unit.

(Taking-in and Taking-out Mechanism)

The taking-in and taking-out mechanism 34 of the base unit 3 and the taking-in and taking-out mechanism 44 of the respective intermediate units 4A to 4C have the same construction and are, as shown in FIG. 6, provided with feed rollers 340, 440 located behind the bill storage sections, dispense rollers 341, 441 located in the bill storage sections, conveyance belts 342, 442 provided between these rollers, stop rollers 343, 443 which are first bill passage restricting rollers disposed in proximity to and above the feed rollers 340, 440, and separating rollers 344, 444 which are second bill passage restricting rollers disposed at positions more toward the bill storage sections than the stop rollers 343, 443 and proximate to and above the conveyance belts 342, 442.

The feed rollers 340, 440 are coupled via gears or the like to dispensing motors 345, 445 which are provided in the respective units 3, 4A to 4C and rotatable in forward and backward directions. By the rotation of the dispensing motors 345, 445 in a specified direction or reverse direction, the feed rollers 340, 440, the conveyance belts 342, 442 and the dispense rollers 341, 441 moved by the feed rollers 340, 440 are driven in a bill taking-in direction or a bill taking-out direction.

Figure 9:
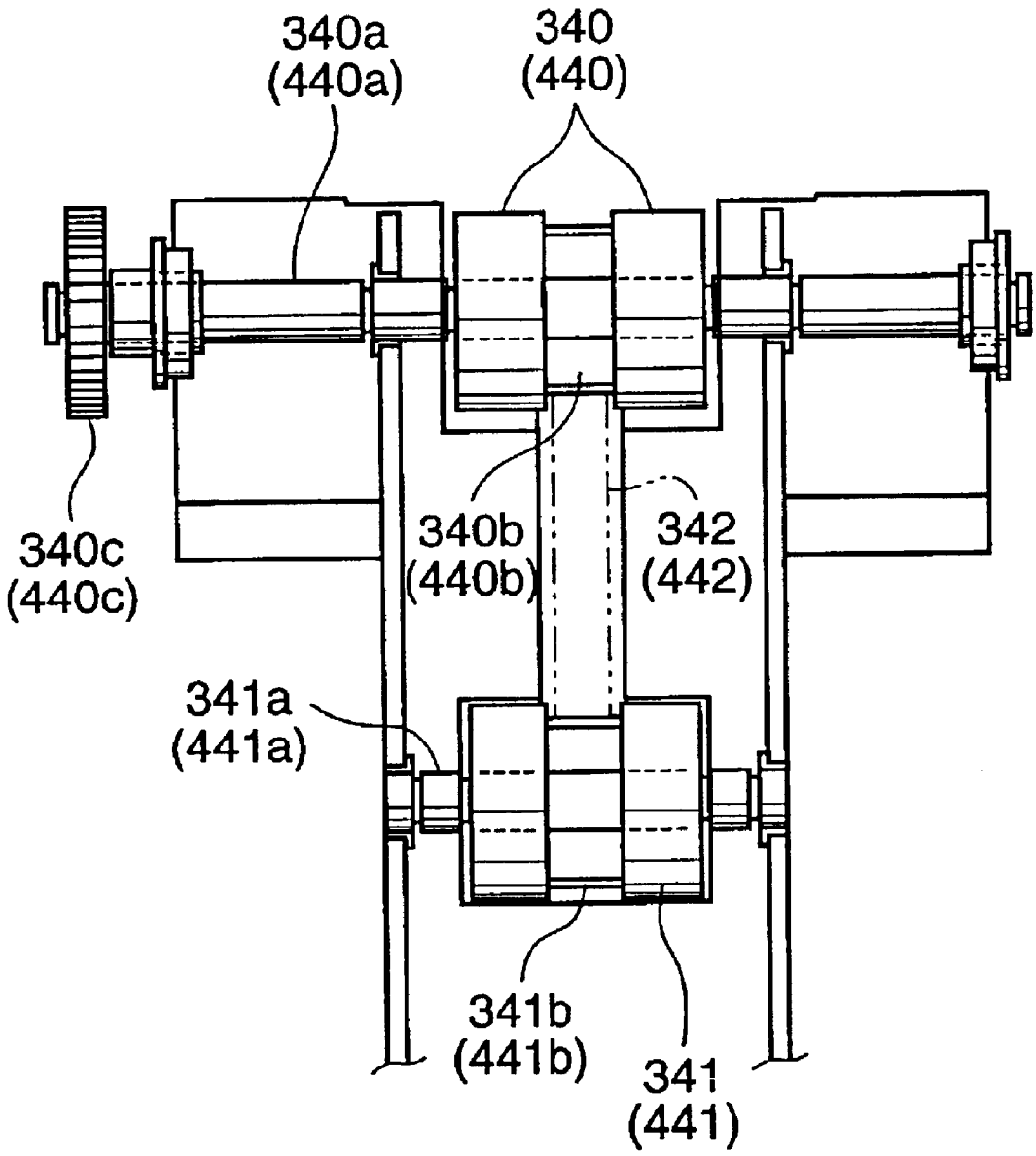
FIG. 9 is a plan view of an assembly including a feed roller shaft and a dispense roller shaft.
Figure 20:
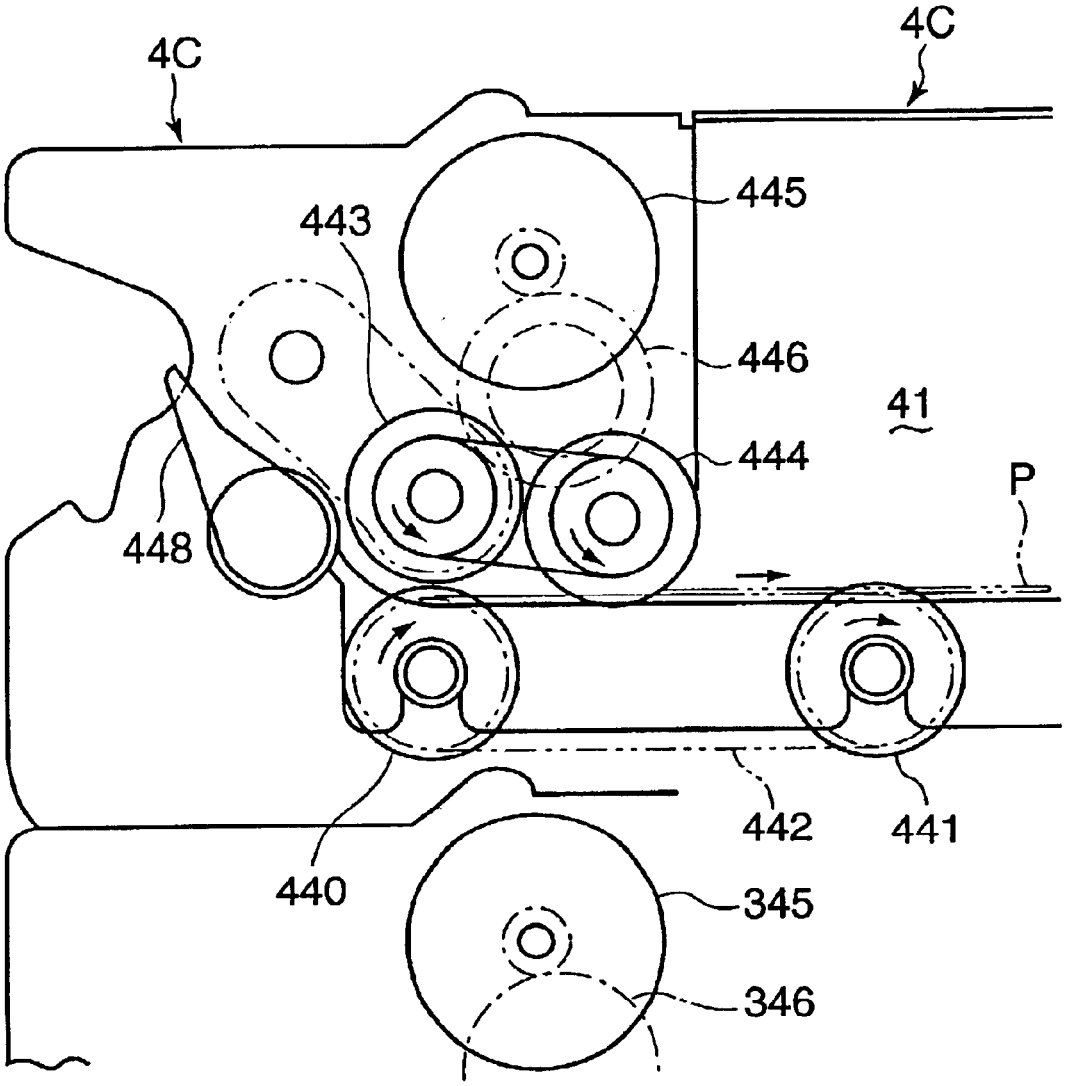
FIG. 20 is a diagram showing operations of a taking-in and taking-out mechanism when a bill is taken into a bill storage section.

More specifically, as shown in FIG. 9, the feed rollers 340, 440 and the dispense rollers 341, 441 are respectively mounted on feed roller shafts 340*a*, 440*a* and dispense roller shafts 341*a*, 441*a* rotatably supported on the frame sections of the units. Pulleys 340*b*, 440*b* and pulleys 341*b*, 441*b* on which the conveyance belts 342, 442 are mounted are provided on these roller shafts 340*a*, 440*a* and 341*a*, 441*a*, and gears 340*c*, 440*c* are mounted on the feed roller shafts 340*a*, 440*a*. The gears 340*c*, 440*c* are coupled to the dispensing motors 345, 445 via intermediate gears 343*e*, 443*e* mounted on the stop roller shafts 343*a*, 443*a* to be described later and intermediate gears 346, 446 shown in FIG. 20.

The stop rollers 343, 443 are rotated in the bill taking-in direction as the transport rollers 320, 420 are rotated at the time of deposit while being stopped at the time of withdrawal. Specifically, as shown in FIG. 8, a plurality of stop rollers 343, 443 are mounted at specified intervals on the stop roller shafts 343*a*, 443*a*, and pulleys 343*c*, 443*c* rotatable together with the pulleys 321*c*, 421*c* mounted on the transport roller shafts 321*a*, 421*a* via the belts 329, 429 are also mounted on these stop roller shafts 343*a*, 443*a*. One-way clutches are built in bearings 343*b*, 443*b* for bearing the stop roller shafts 343*a*, 443*a* and in the pulleys 343*c*, 443*c* so that the stop rollers 343, 443 are rotatable only in one direction.

At positions near one ends of the stop roller shafts 343*a*, 443*a*, pulleys 343*d*, 443*d* on which square belts 347, 447 are mounted for rotating the stop rollers 343, 443 together with the separating rollers 344, 444 are mounted and intermediate gears 343*e*, 443*e* in mesh with the gears 340*c*, 440*c* of the feed roller shafts 340*a*, 440*a* are rotatably mounted.

Figure 10:
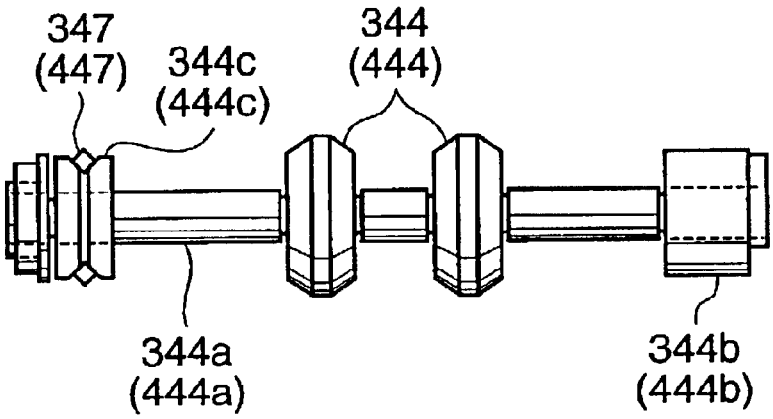
FIG. 10 is a plan view of an assembly of a separating roller shaft.

The separating rollers 344, 444 are rotated together with the stop rollers 343, 443 at the time of deposit, and are stopped at the time of withdrawal. Specifically, as shown in FIG. 10, pulleys 344*c*, 444*c* on which the square belts 347, 447 are mounted for rotating the separating rollers 344, 444 together with the stop rollers 343, 443 are mounted on separating roller shafts 344*a*, 444*a* on which the separating rollers 344, 444 are mounted, and one-way clutches are built in bearings 344*b*, 444*b* for bearing the separating roller shafts 344*a*, 444*a*.

Figure 11:
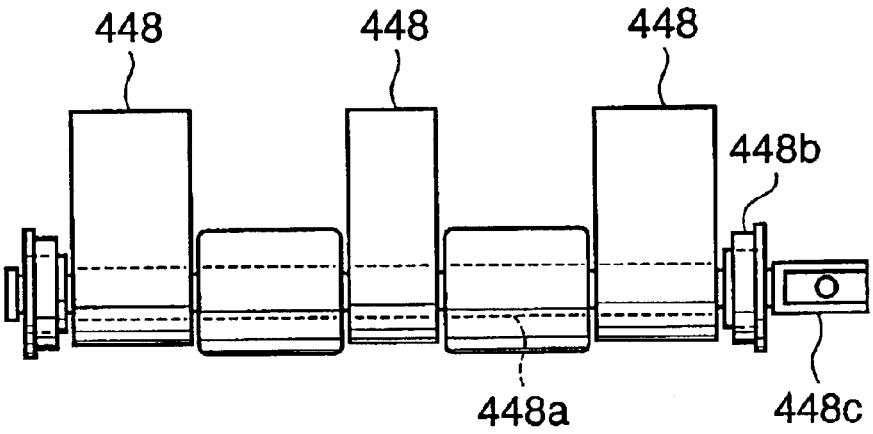
FIG. 11 is a plan view of an assembly incorporated with flappers.
Figure 19:
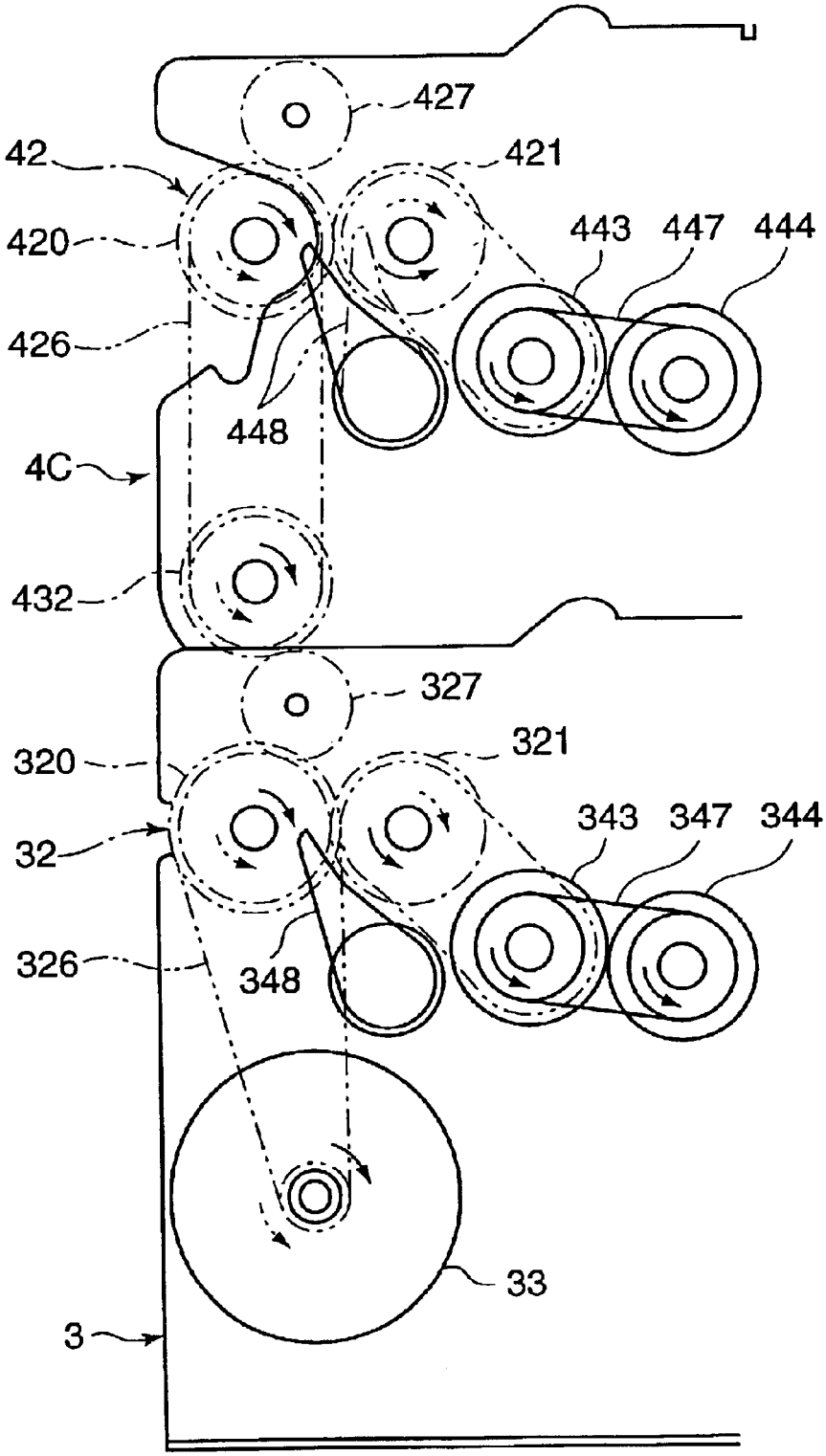
FIG. 19 is a diagram showing an operation of the conveying mechanism.

In each intermediate unit 4A to 4C, a deposit/withdrawal switcher provided with flappers 448 for switching a bill moving path is provided between the conveying mechanism 42 and the taking-in and taking-out mechanism 44. The flappers 448 are mounted on a shaft member 448*a* rotatably supported on the frame section of the unit via bearings 448*b* as shown in FIG. 11. An end 448*c* of the shaft member 448*a* is coupled to a solenoid-type actuator 449 (shown in FIG. 6), and the shaft member 448*a* is rotated by this actuator 449, whereby the flappers 448 are switched between an operative state where the bill can be taken in and taken out by being guided between a position immediately below the upper transport rollers 420, 421 and a position near the feed roller 440 (state shown in solid line in FIG. 19) and a retracted state where the bill is permitted to pass the conveying mechanism 42 (state shown in phantom line in FIG. 19).

Further, a guide member 348 is fixedly provided between the conveying mechanism 32 and the taking-in and taking-out mechanism 34 in the base unit 3.

(Bill Stacking Mechanism)

The bill stacking mechanism 35 of the base unit 3 and the bill stacking mechanisms 45 of the respective intermediate units 4A to 4C have substantially the same construction and are, as shown in FIG. 6, provided with a pair of left and right separating plates 350, 450, movable members 352, 452 for movably holding the separating plates 350, 450 upward and downward, and pressing plates 353, 453 for pressing the stacked bills.

More specifically, as also shown in FIG. 12, the separating plates 350, 350 narrowly extending in forward and backward directions are arranged at the opposite lateral sides of the bill supporting tables 312, 412 and the pressing plates 353, 453 are arranged above the tables 312, 412 between the separating plates in the bill storage sections 31, 41. The separating plates 350, 350 have projections 351, 451 having an L-shaped cross section along their inner edges and are held by the movable members 352, 452 mounted movably upward and downward on the side plates of the bill storage sections 31, 41 so that the projections 351, 451 can be moved upward and downward between a raised position where the projections 351, 451 are located above bill supporting surfaces (upper surfaces) of the tables 312, 412 and a lowered position where they are located below the bill supporting surfaces.

Figure 12A:
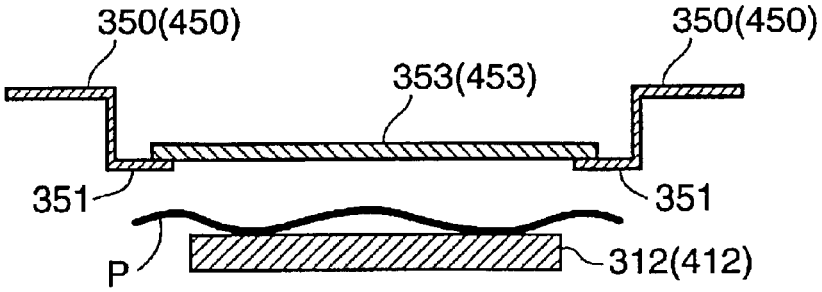
FIGS. 12A to 12D are diagrams showing operations of a bill stacking mechanism.
Figure 12B:
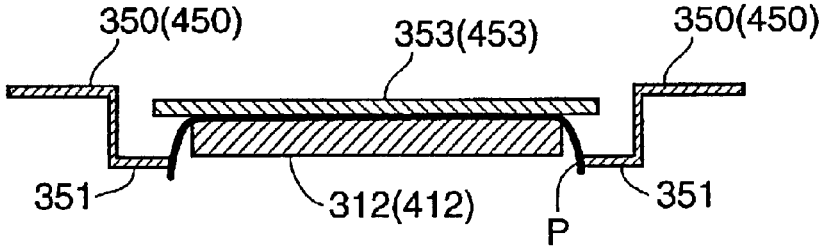
Figure 12C:
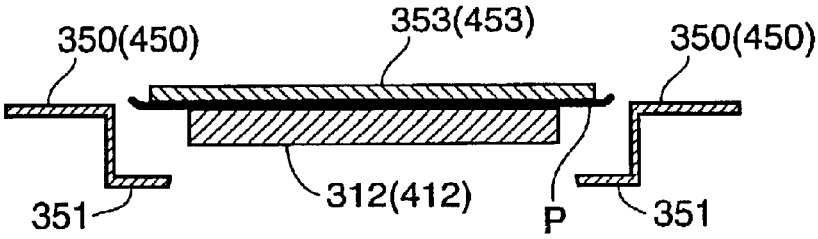
Figure 12D:
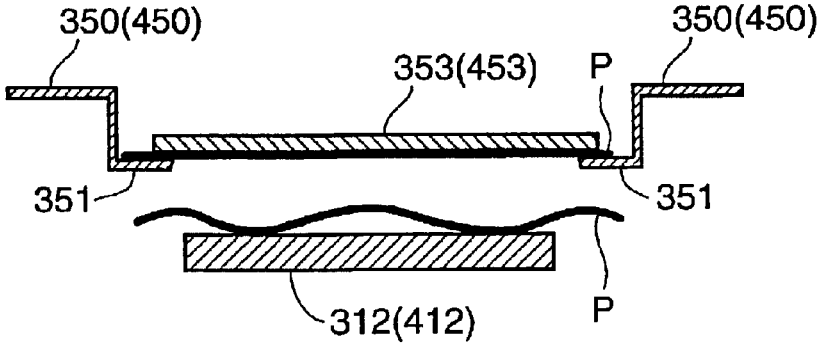

When the separating plates 350, 450 are located at the raised position before the bills are stacked, the pressing plates 353, 453 are placed on the projections 351, 451 of the separating plates 350, 450 as shown in FIG. 12A. When the separating plates 350, 450 are lowered after the bill P is conveyed onto the tables 312, 412 in this state, the projections 351, 451 of the separating plates 350, 450 pass at the sides of the table 312, 412 while bending the opposite side portions of the bill P and the pressing plate 353, 453 is placed on the bill P on the table 312, 412 as shown in FIG. 12B. When the separating plates 350, 450 reach the lowered position as shown in FIG. 12C, the side edges of the bill P are separated from the projections 351, 451 and are returned to an unbent state as shown in FIG. 12C. When the separating plates 350, 450 are moved upward again thereafter, the bill P and the pressing plates 353, 453 pressing the bill P is held on the projections 351, 451 of the separating plates 350, 450 and the bill P is taken onto the table 312, 412 below the separating plates 350, 450 as shown in FIG. 12D. The bills P are stacked by repeating the operations of FIGS. 12A to 12D.

Referring back to FIG. 6, the driving mechanism 36 for driving the bill stacking mechanism is provided in the base unit 3 and includes an eccentric cam 362 driven by a lifter motor 360 via a gear 361 and a substantially triangular lifter 363 which is engaged with an eccentric shaft of the cam 362 to move upward and downward as the cam 362 is rotated. By coupling the movable member 352 of the bill stacking device 35 to the lifter 363, the separating plates 350 can be moved upward and downward as the lifter motor 360 is driven.

In order to transmit the driving force of the driving mechanism 36 to the respective intermediate units 4A to 4D, a plate piece 355 made of a ferromagnetic material such as an iron plate is provided at the upper end of the movable member 352, whereas a plate piece 455 made of a ferromagnetic material such as an iron plate is provided at the upper end of the movable member 452 of each intermediate unit 4A to 4C and a magnet 456 is mounted at the bottom end thereof. The movable members located immediately one over the other are coupled by the attraction of the magnet 456 and the plate piece 355 or 455 at the upper end of the movable member of the lower unit, whereby the driving force for elevating the movable member is transmitted from the lower unit to the upper unit. Identified by 357, 457 are guide rollers for the movable members 352, 452.

(Constructions of the Auxiliary Unit, etc.)

The auxiliary unit 5 is provided with the storage space expanding portion 51 in communication with the bill storage section 41 of the unit 4A located there below and the conveying mechanism 51 behind the expanding portion 51. Although not shown in detail, the conveying mechanism 52 includes a pair of upper rollers and a pair of lower rollers as in the conveying mechanisms 42 of the intermediate units 4A to 4C, gears mounted on the respective roller shafts, a transmission belt mounted between pulleys provided on one upper roller shaft and one lower roller shaft, and an intermediate transmission gear in mesh with the gear provided on one upper roller shaft. The respective rollers are rotated together, and the driving force is transmitted from the lower unit while being transmitted to the upper unit.

In the base unit 3 and the intermediate units 4A to 4C, end sensors 315, 415 for detecting the absence of the stacked bills are provided in the bill storage sections, count sensors 328, 428 are provided in the conveying mechanism 32, 42, and sensors 358, 359 for detecting the upward and downward movements of the separating plates 350, 450 are provided in the bill stacking mechanisms 35, 45 (see FIG. 14).

(Operation of the Bill Handling Apparatus)

Figure 15:
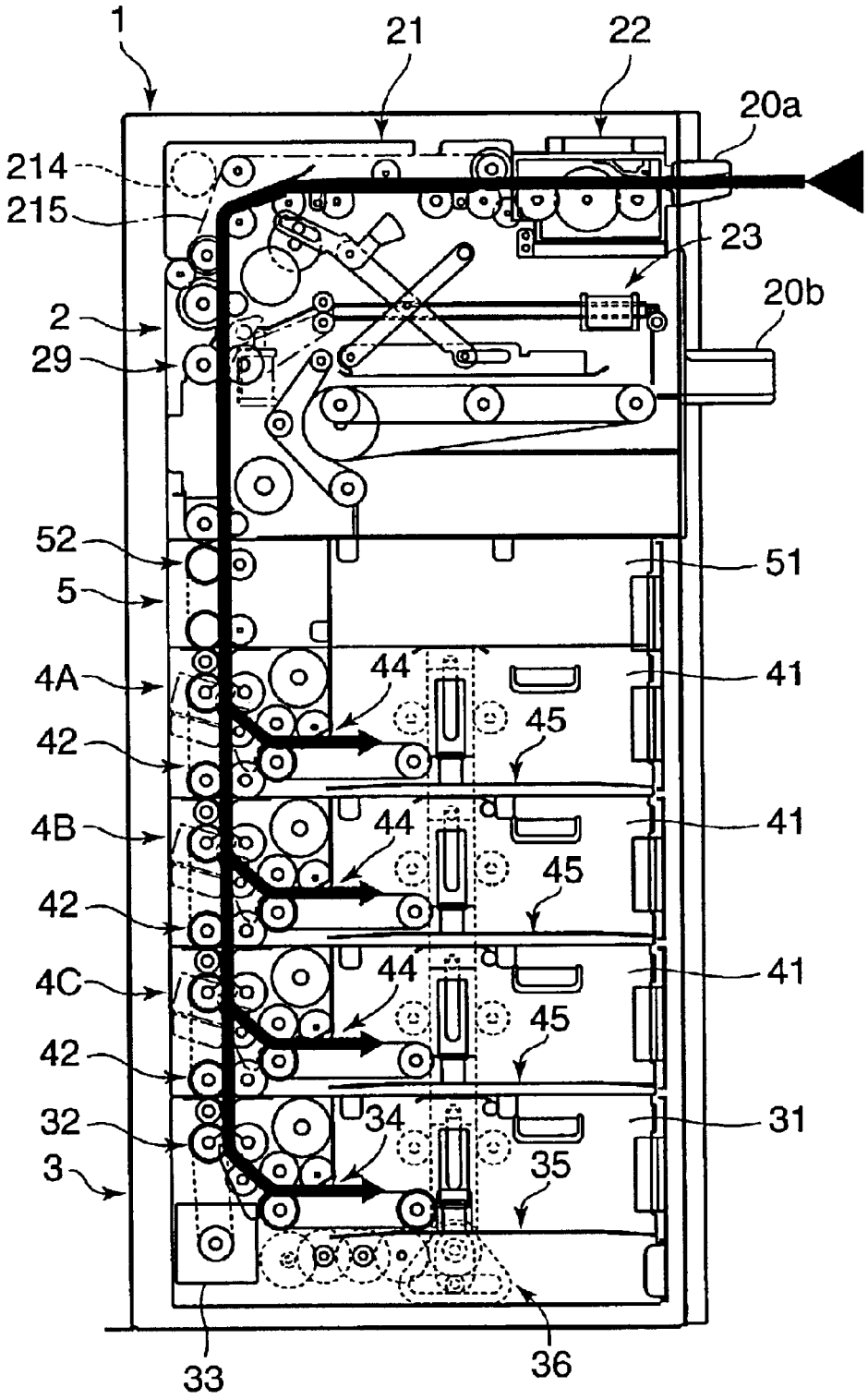
FIG. 15 is a diagram showing a flow of bills at the time of deposit by the bill handling apparatus.
Figure 16:
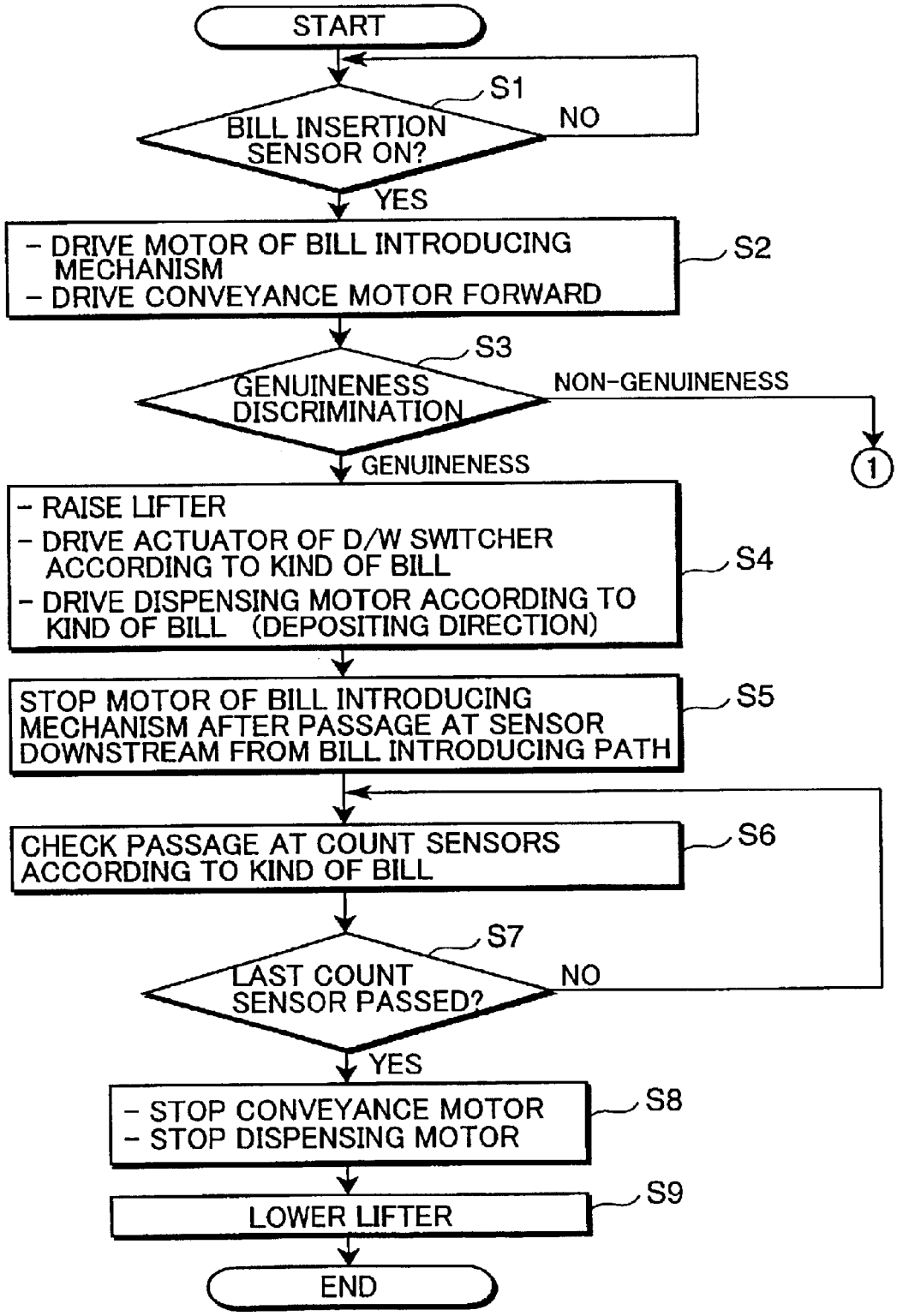
FIG. 16 is part of a flowchart showing a control executed at the time of deposit.
Figure 21:
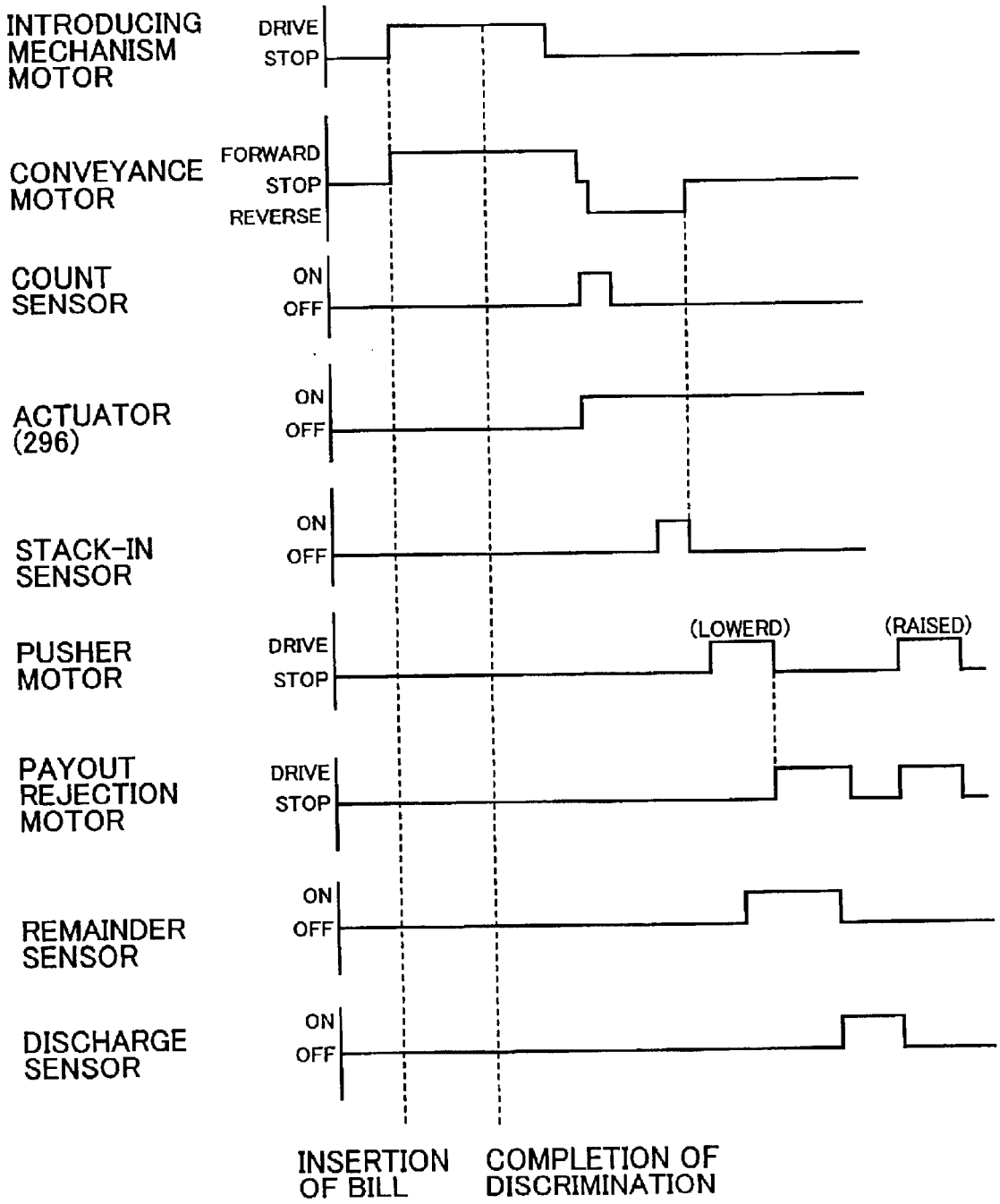
FIG. 21 is a timing chart in the case that a bill is returned due to its nongenuineness at the time of deposit.
Figure 22:
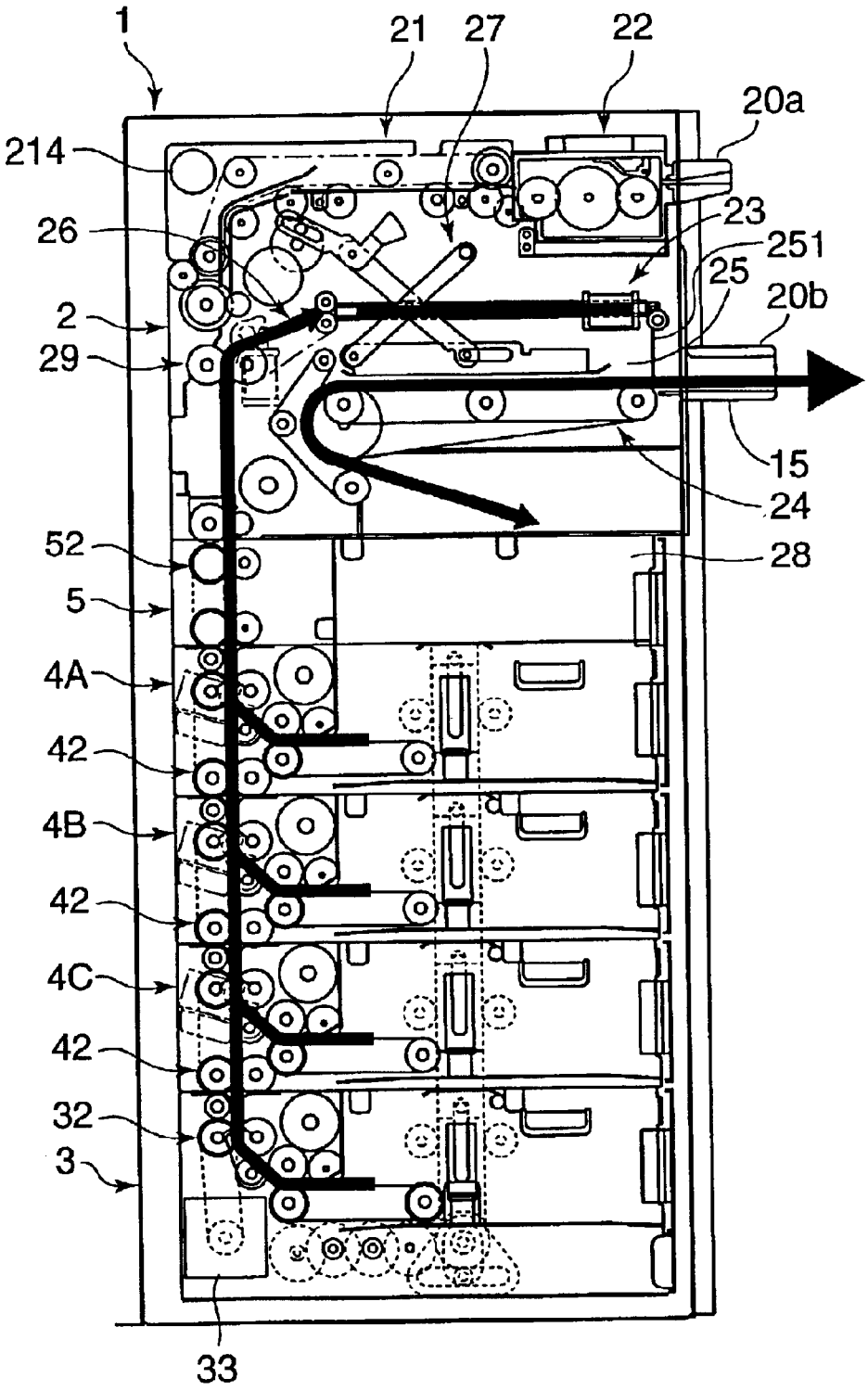
FIG. 22 is a diagram showing a flow of bills at the time of withdrawal by the bill handling apparatus.

A flow of bills when deposit is made to the bill handling apparatus is schematically as shown in FIG. 15, and the operation of the bill handling apparatus at the time of deposit is as shown in FIGS. 16 to 20, whereas the operation thereof in the case that a counterfeit bill is deposited is as shown in FIG. 21. Further, a flow of bills when withdrawal is made from the bill handling apparatus is schematically as shown in FIG. 22, and the operation of the bill handling apparatus at the time of withdrawal is as shown in FIGS. 23 to 26.

With reference to FIGS. 15 to 26, the operations of the bill handling apparatus are successively described for a usual case of deposit, a case where a counterfeit bill is deposited, a usual case of withdrawal, and a case where rejection is necessary at the time of withdrawal.

(1) Operation at the Time of Deposit

The operation at the time of deposit is as follows. Whether or not a bill has been inserted through the bill insertion slot 20*a* is checked in accordance with a signal from a sensor (not shown) provided near the bill insertion slot 20*a* in Step S1 of a flowchart of FIG. 16. When being inserted, the bill is introduced to the bill introducing path 210 through the discriminating device 22 by the driving of the motor 214 of the bill introducing mechanism 21, and the genuineness and the kind of this bill are discriminated during this time in Step S2. At this time, the bill is introduced at a relatively low speed by the driving of the motor 214. The conveyance motor 33 is also driven in forward direction as a preparation for the conveyance by the conveying mechanism. The conveyance motor 33 is driven at a higher speed than the motor 214 in order to increase a moving speed of the bill when the bill is transferred to the conveying mechanism via the bill introducing mechanism 21.

Next, the genuineness of the bill is judged in Step S3, the unit into which the bill should be taken is determined according to the kind of the discriminated bill if the bill is discriminated to be genuine, and various mechanisms necessary to take the bill in are driven in Step S4. Specifically, the conveyance motor 33 continues to be driven, the lifter 363 is raised by driving the lifter motor 360 as a preparatory operation to stack the bills, the actuator 449 of the deposit/withdrawal switcher is driven to introduce the bill to the bill storage section 41 of the unit in the case that the unit in conformity with the kind of the bill is any of the intermediate units 4A to 4C, and the dispensing motor 445 or 345 of the unit in conformity with the kind of the bill is driven (Step S4).

Figure 18:
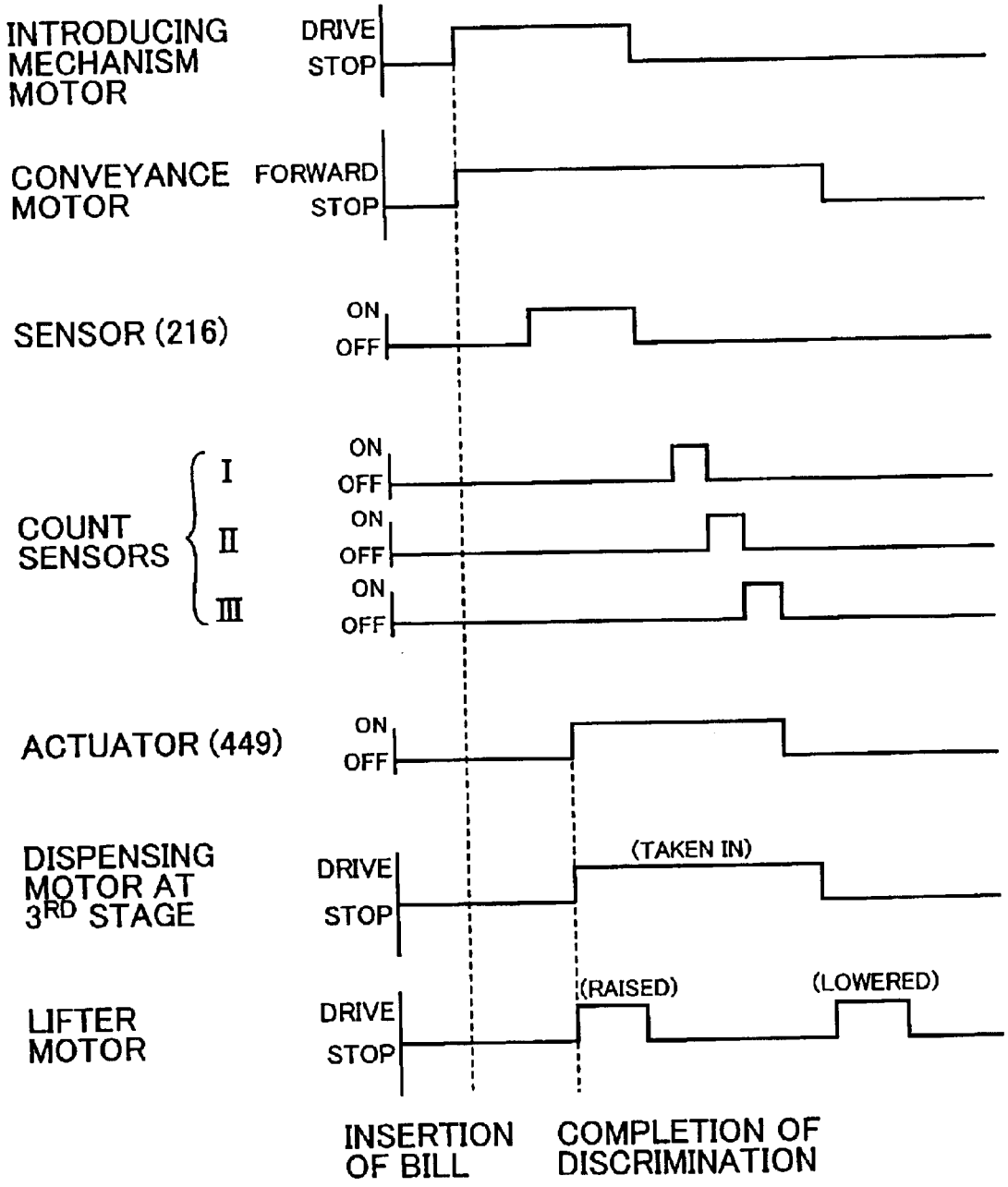
FIG. 18 is a timing chart for an exemplary case where deposit is made to the intermediate unit at the third stage.

For example, in the case that the bill is discriminated to be a 5000-yen bill, the lifter motor 360 is driven, the conveyance motor 33 is driven in forward direction at high speed, and the actuator 449 and the dispensing motor 445 of the intermediate unit 4C at the third stage are driven as shown in FIG. 18. In this way, the conveying mechanisms 32, 42 are driven as shown in solid-line arrows in FIG. 19, and the actuator 449 of the unit 4C is brought to a state shown in solid line in FIG. 19, whereby the bill being conveyed downward by the conveying mechanism is introduced to the taking-in and taking-out mechanism 44 of the unit 4C by the flappers 448 of the unit 4C after passing the units 4A, 4B, and is further taken into the bill storage section 41 after being conveyed over the feed belt 442 by the rotation of the feed roller 440, the feed belt 442, the dispense roller 441, the stop roller 443 and separating roller 444 which are driven by the dispensing motor 44 as shown in arrows in FIG. 20.

In such a bill taking-in operation, the bill can be stably and securely taken to a specified position in the bill storage section 41 by the feed roller 440, the feed belt 442 and two rollers 443, 444 disposed above them. Particularly, since the bill can be taken to the more backward side of the bill storage section 41 as compared to a case where the separating roller 444 is not provided, the bill is less likely to be jammed and get caught by an other member while being taken in and stacked, with the result that the bill can be securely and stably taken in and stacked.

The motor 214 of the bill introducing mechanism is stopped after the bill passes the sensor 216 at the downstream side of the bill introducing path 210 (Step S5). Further, the conveyance motor 33 and the dispensing motor 445 or 345 are stopped after the bill passes the last count sensor based on checks made on the passage of the bill by the count sensors provided in the conveyance path to the unit in conformity with the kind of the bill (Steps S6 to S8). After the bill is taken in, the lifter motor 360 is so driven to lower the lifter 363 of the bill stacking mechanism (Step S9).

(2) Operation in the Case that a Counterfeit Bill is Deposited.

Figure 17:
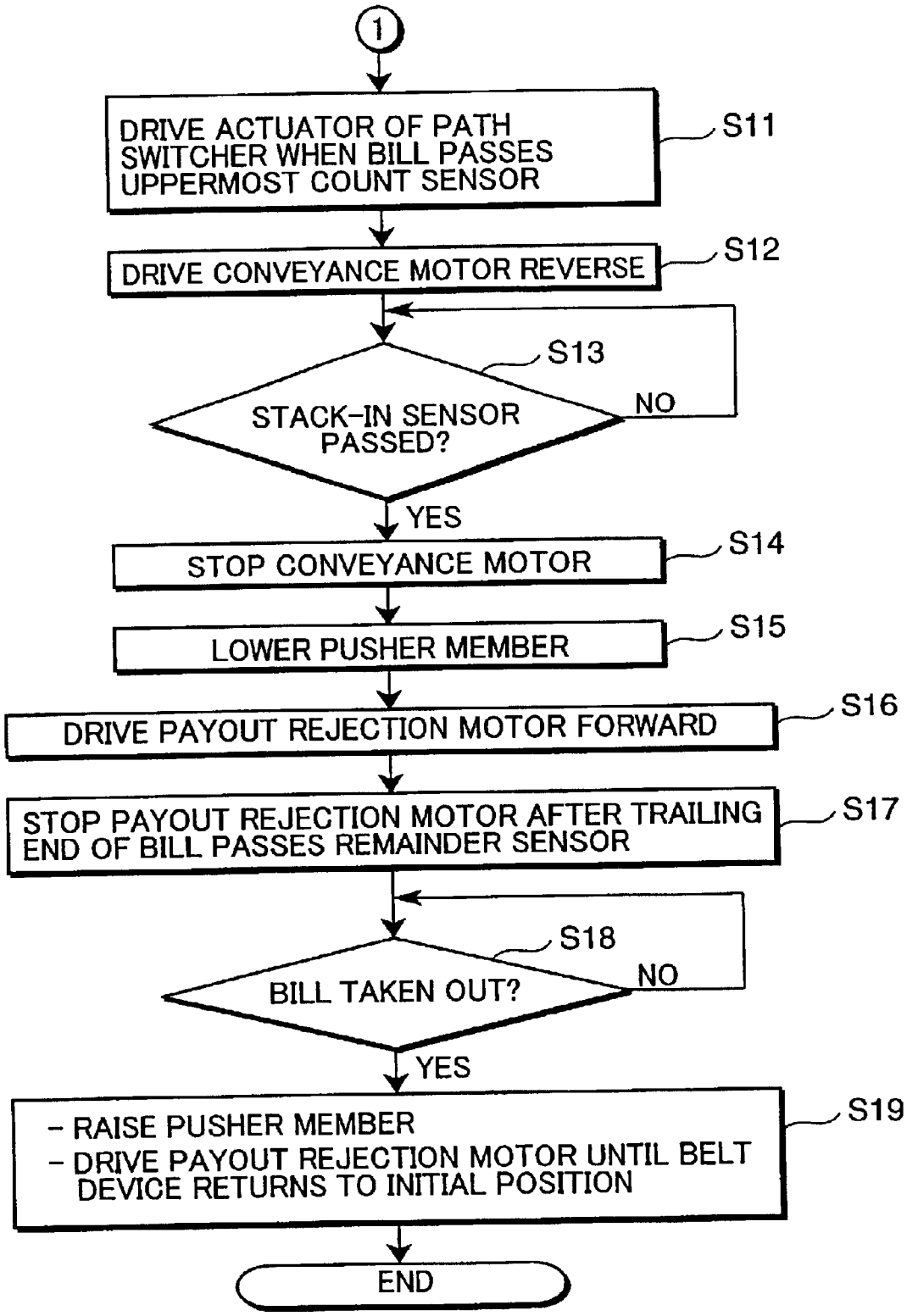
FIG. 17 is remaining part of the flowchart showing the control executed at the time of deposit.

If the bill is discriminated to be counterfeit in Step S3, a control shown in Steps S11 to S19 of FIG. 17 and a timing chart of FIG. 21 is executed. Specifically, the actuator 296 of the introduce/discharge switcher is driven when the bill passes the uppermost count sensor 428, whereby the flapper 295 guides the reversely conveyed bill toward the bill discharging mechanism 23 (Step S11). Subsequently, the conveyance motor 33 is switched to rotate in reverse direction (Step S12) and then the conveyance motor 33 is stopped when the bill passes the stack-in sensor 231 (Steps S13, S14). Further, the pusher motor 273 is so driven to lower the pusher 270.

In this way, the counterfeit bill having been conveyed to an intermediate position of the conveyance path is guided toward the bill discharging mechanism 23 in a switch-back manner, and is stored in the temporary storage section 25 on the belt device 24 by the aforementioned operations of the guiding device 26 and the pusher device 27.

Further, the payout rejection motor 247 is driven in forward direction (Step S16), whereby the counterfeit bill is conveyed to the discharge slot 20*b*. The payout rejection motor 247 is stopped after a trailing end of the bill passes the remainder sensor 233, and then the pusher motor 273 is so driven to return the pusher 270 to the raised position and the payout rejection motor 247 is driven until the belt device 24 is returned to its initial position when a withdrawal of the bill from the discharge slot 20*b* is confirmed in accordance with a signal from the discharge sensor 234.

(3) Operation at the Time of Withdrawal

At the time of withdrawal, the kinds and the number of the bills to be dispensed are determined by the control board unit 100, the bills are taken out from the bill storage sections of the units in conformity with the kinds of the bills to be dispensed by controlling the corresponding motors, solenoids, etc. and are discharged through the discharge slot 20*b* via the temporary storage section 25.

Figure 23:
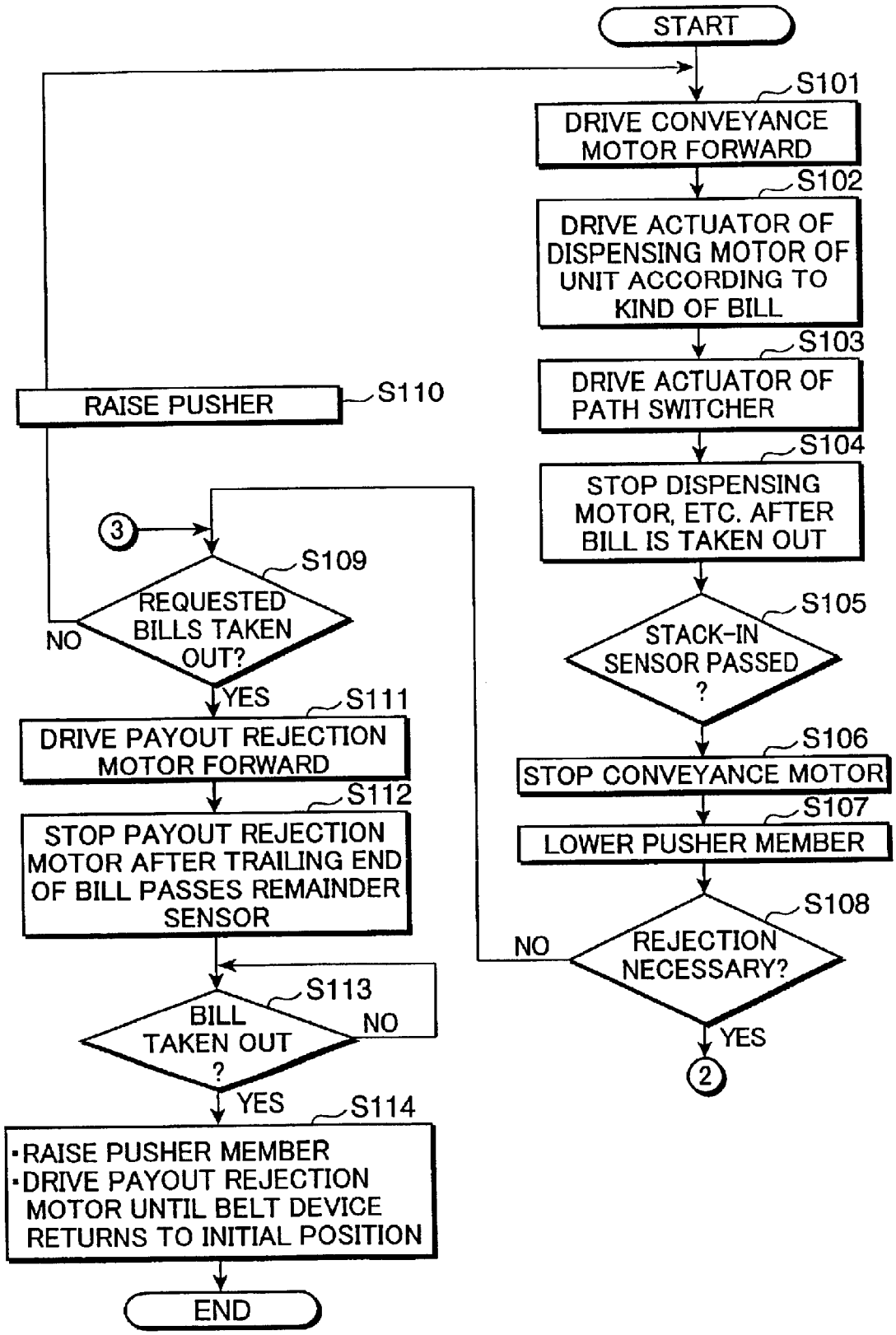
FIG. 23 is part of a flowchart showing a control executed at the time of withdrawal.

Specifically, the conveyance motor 33 is first driven in reverse direction at high speed in response to a payout order in Step S101 of a flowchart of FIG. 23. In Step S102, the dispensing motor 445 or 345 of the unit in conformity wit the kind of the bills to be dispensed are driven and the actuator 449 of the deposit/withdrawal switcher is driven in the case that the unit in conformity with the kind of the bill is any of the intermediate units 4A to 4C. For example, in the case of taking the bill out from the bill storage section 41 of the intermediate unit 4C at the third stage, the conveyance motor 33 is driven in reverse direction and the dispensing motor 445 and the actuator 449 of this unit 4C are driven.

Figure 26:
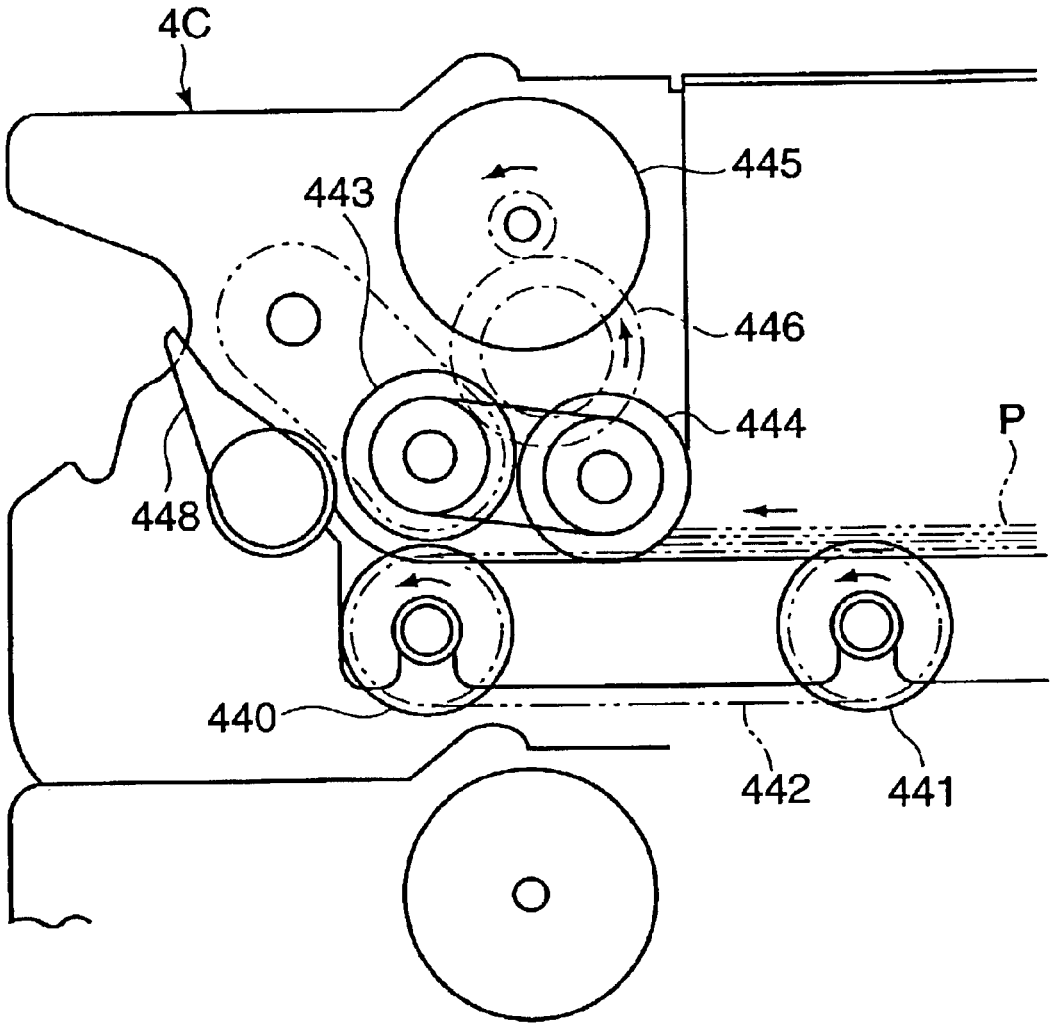
FIG. 26 is a diagram showing operations of the taking-in and taking-out mechanism when bills are taken out from the bill storage section.

Then, as shown in arrows in FIG. 26, the feed roller 440, the feed belt 442 and the dispense roller 441 are driven in the bill taking-out direction to dispense the bill P. In this case, since the stop roller 443 and the separating roller 444 are held in their stopped states at the time of withdrawal as described above, the passage of the bills is first restricted by the separating roller 444 and only a small number of bills P out of those stacked in the bill storage section 41 pass the separating roller 444. The passage of the bills is further restricted by the stop roller 443, with the result that the bills are dispensed one by one.

Since the bills are separated at two stages by the separating roller 444 and the stop roller 443 in this way, a multiple feed of bills where a plurality of bills are dispensed in an overlapping state can be securely prevented.

The dispensed bill is moved upward via the conveying mechanism 42, 52, 29. The actuator 296 of the introduce/discharge switcher is driven (Step S103) at the time of withdrawal, whereby the flapper 295 is brought to a state shown in phantom line in FIG. 5 and the bill is guided toward the bill discharging mechanism 23. The dispensing motor 445 is stopped upon the elapse of a specified time after the bill is dispensed (Step S104).

The conveyance motor 33 is stopped (Steps S105, S106) when the bill guided toward the bill discharging mechanism 23 passes the stack-in sensor 231, and the pusher motor 273 is so driven as to lower the pusher 270 (Step S107). In this way, the bill is stored in the temporary storage section 25 on the belt device 24 by the aforementioned operations of the guiding device 26 and the pusher device 27.

It is then discriminated whether the bill is a rejected bill (Step S108). Unless the bill is a rejected bill, it is discriminated whether all the requested bills have been dispensed (Step S109). If the discrimination result in Step S109 is negative, this routine returns to Step S101 after the pusher motor 273 is driven to return the pusher 270 to the raised position (Step S110).

Figure 25:
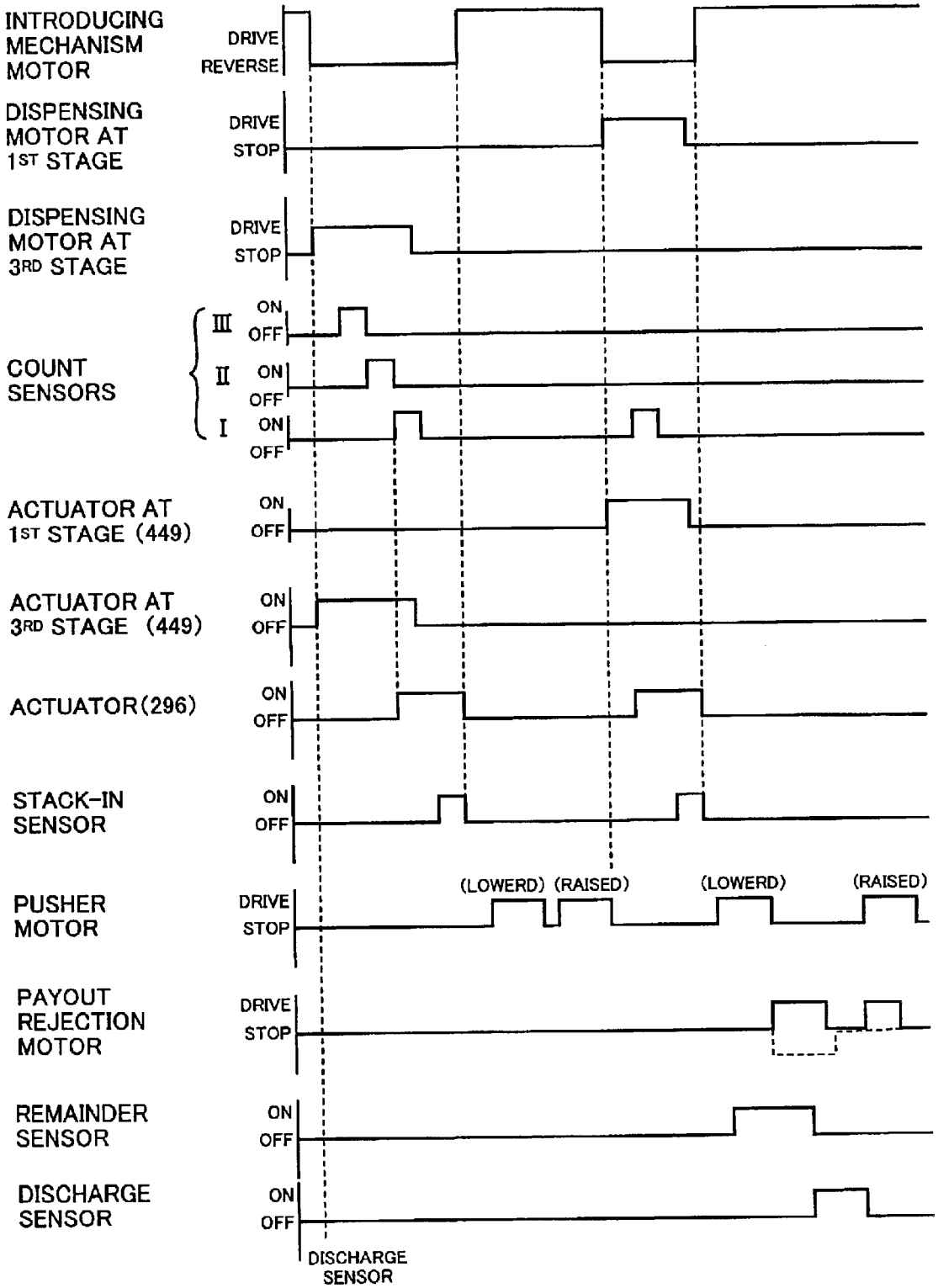
FIG. 25 is a timing chart for an exemplary case where bills are taken out one by one from the intermediate units at the third and first stages.

The aforementioned operations of Steps S101 to S109 are repeated until all the requested bills are dispensed and stored in the temporary storage section. For example, in the case of a request to dispense one 5000-yen bill and one 1000-yen bill, the 5000-yen bill and the 1000-yen bill are stacked in the temporary storage section 25 on the belt device 24 by successively performing reverse driving of the conveyance motor 33, driving of the dispensing motor 445 of the intermediate unit 4A at the first stage and the actuator 449 of the deposit/withdrawal switcher, driving of the actuator 296 of the introduce/discharge switcher and driving of the pusher motor 273 after successively performing reverse driving of the conveyance motor 33, driving of the dispensing motor 445 of the intermediate unit 4C at the third stage and the actuator 449 of the deposit/withdrawal switcher, driving of the actuator 296 of the introduce/discharge switcher and driving of the pusher motor 273 as also shown in FIG. 25.

After a specified number of bills conforming to the request are dispensed and temporarily stored, operations similar to those of Step S16 to S19 are performed in Steps S111 to S114. As a result, the specified number of bills stored in the temporary storage section 25 are conveyed to the discharge slot 20*b* at once.

(4) Operation in the Case that Rejection is Necessary at the Time of Withdrawal

Figure 24:
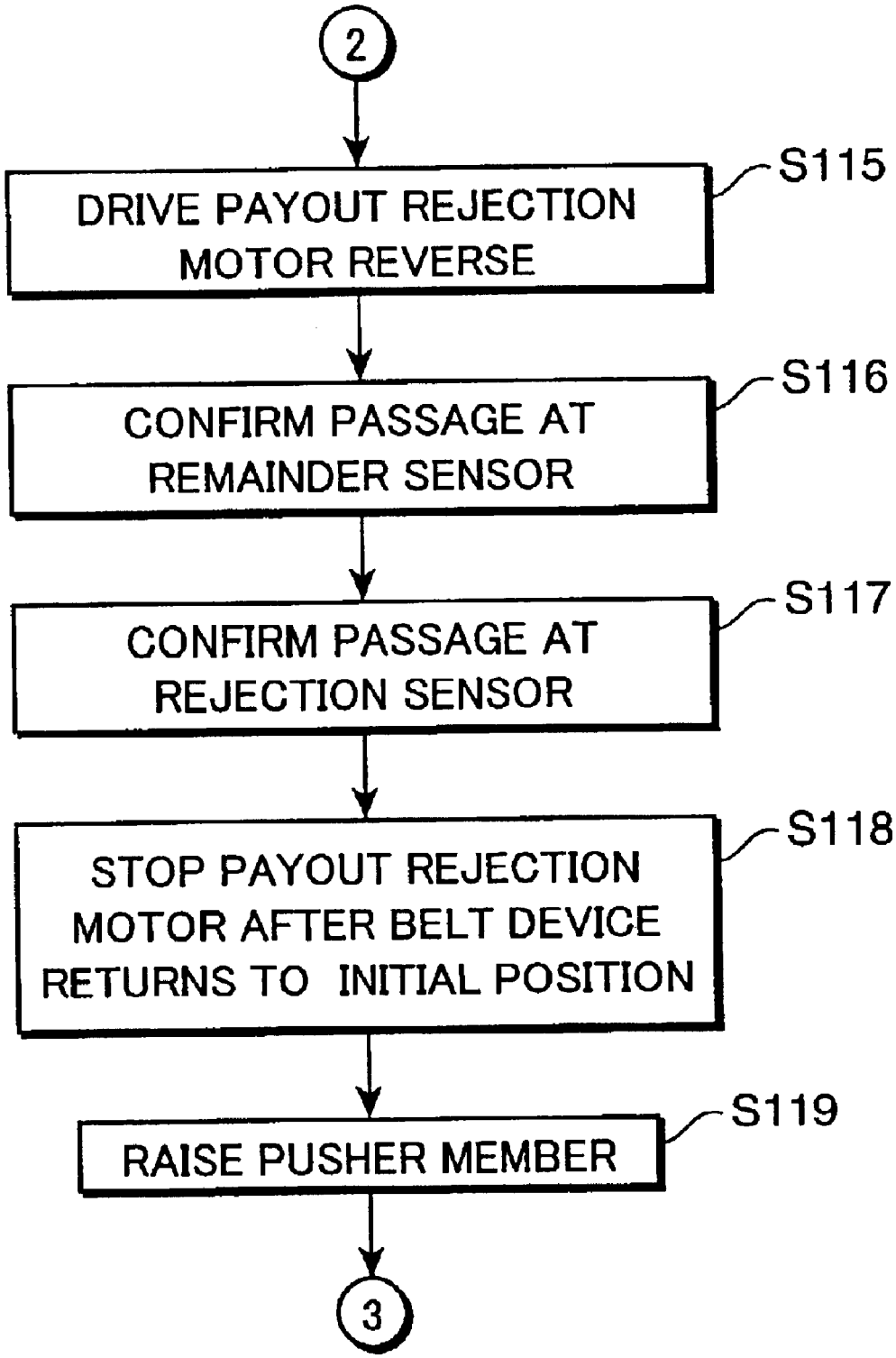
FIG. 24 is remaining part of the flowchart showing the control executed at the time of withdrawal.

If rejection is discriminated to be necessary due to a multiple withdrawal in Step S108, the payout rejection motor 247 is driven in reverse direction in Step S115 of FIG. 24 (see broken line in FIG. 25), whereby the bill is conveyed to the rejection chamber 28. After the bill is conformed to have passed the remainder sensor 233 and further the rejection sensor 232, the belt device 24 is returned to its initial position and the payout rejection motor 247 is stopped.

(Functions and Effects)

A plurality of kinds of bills can be handled by taking in, withdrawing and rejecting the bills as described above.

Particularly, upon manufacturing this bill handling apparatus, the number of the bill storage sections in conformity with the requested kinds of bills to be handled can be easily set and changed.

More specifically, the mechanisms for introducing, discriminating and withdrawing the bills, the respective bill storage sections and the mechanisms for taking the bills in and dispensing the bills from the respective bill storage sections are formed into common units: the deposit/withdrawal unit 2 at the top stage, the base unit 3 at the bottom stage and the intermediate units 4A to 4C between the units 2 and 3, and the conveying mechanisms 29, 32, 42 are incorporated in the respective units. Thus, the bill storage section and the internal mechanism are formed into a commonly usable unit. Therefore, bill handling apparatuses corresponding to various kinds of bills can be obtained by changing the number of the intermediate units and changing the size of the casing. For example, the shown bill handling apparatus having the intermediate units 4A to 4C at three stages correspond to four kinds of bills. The bill handling apparatus corresponds to three kinds of bills if the number of the intermediate units is reduced to two while corresponding to two kinds of bills if it is reduced to one. Further, if the number of the intermediate units is increased from the shown example, the bill handling apparatus can correspond to five or more kinds of bills.

Further, since the respective units 2, 3, 4A to 4C are individually withdrawal from the casing 1 in this embodiment, repair, exchange and the like can be easily done in the case of maintenance of the respective units and in the case of a defect or a damage in some of the units.

Further, since the conveyance motor 33 as a driving source for the conveying mechanisms is provided in the base unit 3 and the driving force thereof is transmitted to the conveying mechanisms of the respective units via the transmitter, the conveying mechanisms 29, 32, 42 of the respective units can be synchronously driven by one driving source. Furthermore, since the gears (intermediate transmission gears 327, 427 and the gears in mesh therewith) are used in the transmitting portions between the units, the transmitting portions between the units are easily separable when the unit is separated or individually withdrawn from the casing while being easily connectable (engageable) when the units are combined.

Further, the dispensing motors 345, 445 as the driving portions of the taking-in and taking-out mechanism are individually provided in the base unit 2 and the respective intermediate units 4A to 4C and the flappers 446 (switcher) and the actuators 449 as the driving portions of the flappers 446 are individually provided in the respective intermediate units 4A to 4C. Thus, operations of taking the bills into the bill storage sections and operations of taking the bills out of the bill storage sections can be individually controlled for each of the bill storage sections.

Further, since the auxiliary unit 5 is provided atop one intermediate unit 4A in the apparatus of this embodiment, the storage space of the bill storage section of this intermediate unit 4A can be increased. Accordingly, this intermediate unit 4A may be allotted to the kind of bills expected to be stored in large quantity.

It should be noted that the auxiliary unit 5 may be provided for the other intermediate unit 4B or 4C or the base unit 3 and may be omitted if there is no demand for increasing the storage space.

(Other Embodiments)

Several other embodiments are described below.

(1) Another Example of the Taking-in and Taking-out Mechanism

Figure 27:
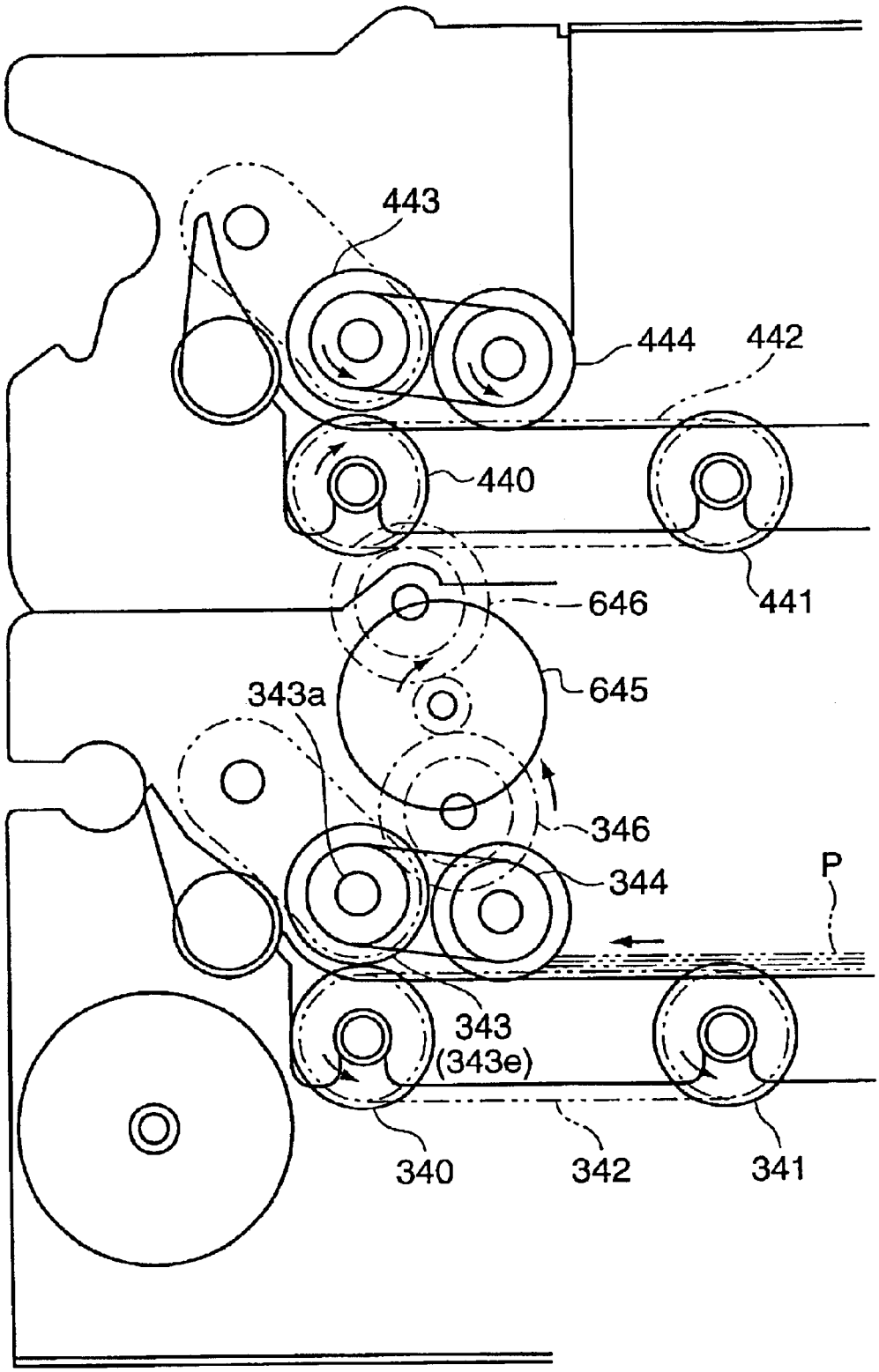
FIG. 27 is a diagram showing the construction of a taking-in and taking-out mechanism according to another embodiment and an operation thereof when bills are taken out at the lower stage.
Figure 28:
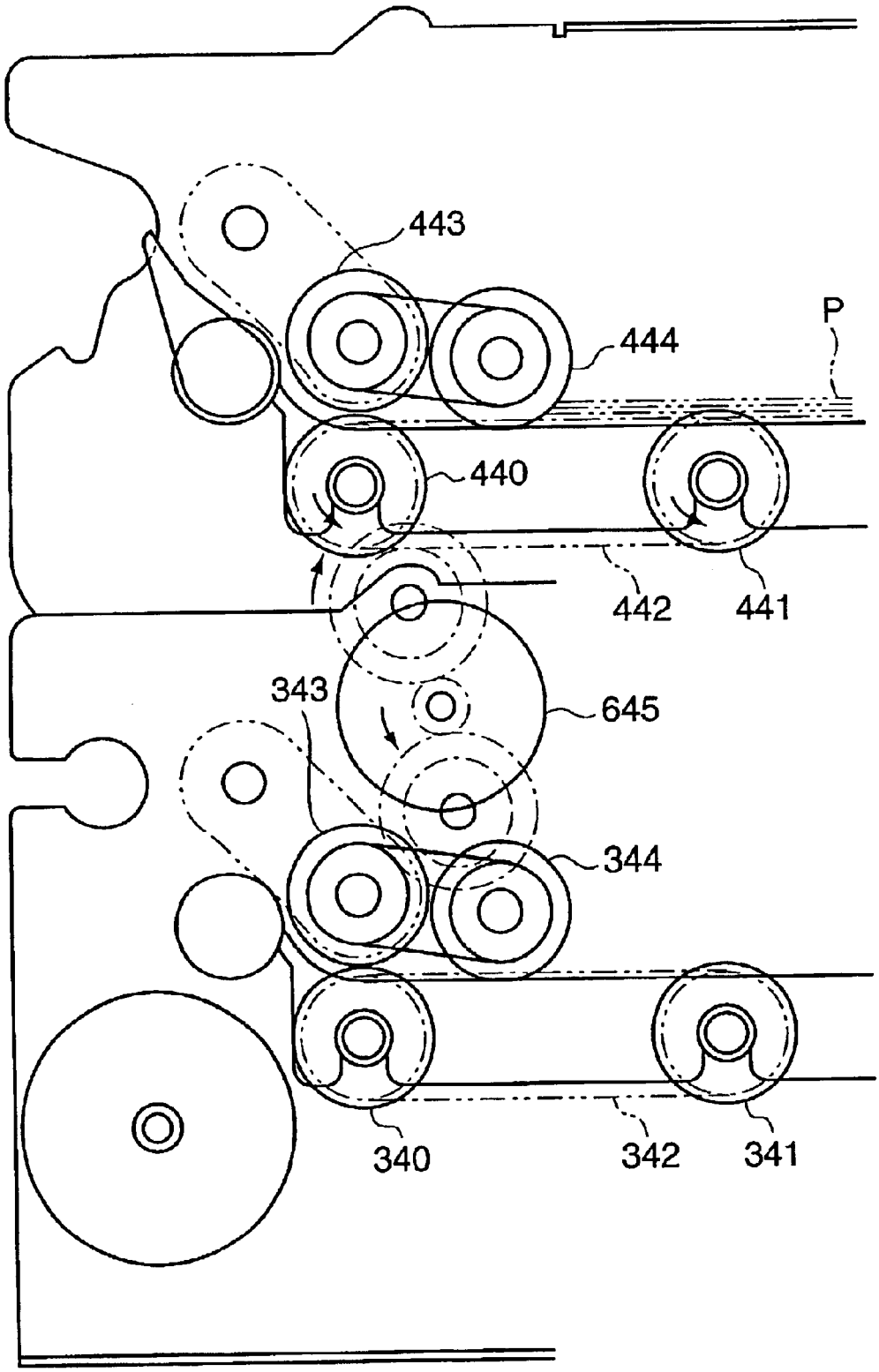
FIG. 28 is a diagram showing an operation performed when bills are taken out from the taking-in and taking-out mechanism at the upper stage in FIG. 27.

Although the dispensing motor 345 is provided for each of the taking-in and taking-out mechanisms of the base unit 3 and the intermediate units 4A to 4C in the foregoing embodiment, one dispensing motor 645 may be commonly used for the taking-in and taking-out mechanisms of the two units arranged one over the other (e.g., the base unit 3 and the intermediate unit 4C) as shown in FIGS. 27 and 28.

Specifically, in the embodiment shown in FIGS. 27 and 28, the dispensing motor 645 and the feed roller 340 of the taking-in and taking-out mechanism 34 at the lower stage are coupled via the first intermediate gear 346 mounted on the intermediate gear shaft and the second intermediate gear 343*e* rotatably mounted on the stop roller shaft 343*a*, and the dispensing motor 645 and the feed roller 440 of the taking-in and taking-out mechanism 44 at the upper stage are coupled via only one intermediate gear 646.

By changing the number of the transmission gears at the lower and upper stages in this way, the feed rollers 340, the feed belt 342 and the dispensing roller 341 of the taking-in and taking-out mechanism 34 at the lower stage are driven in the bill taking-out direction when the dispensing motor 645 is driven in a specified direction (clockwise direction) as shown by an arrow in FIG. 27, whereas the feed rollers 440, the feed belt 442 and the dispensing roller 441 of the taking-in and taking-out mechanism 44 at the upper stage are driven in the bill taking-out direction when the dispensing motor 645 is driven in a direction (counterclockwise direction) reverse from the one in FIG. 15 as shown by an arrow in FIG. 28.

Such an arrangement reduces the number of the dispensing motors, which is advantageous in reducing the production costs and making the apparatus smaller and lighter. In this embodiment, by providing the feed rollers 340, 440 with a one-way clutch, the feed roller 440 and the like of the taking-in and taking-out mechanism 44 at the upper stage may be stopped when the dispensing motor 645 is driven in the specified direction to drive the feed roller 340 and the like of the taking-in and taking-out mechanism 34 at the lower stage in the bill taking-out direction, whereas the feed roller 340 and the like of the taking-in and taking-out mechanism 34 at the lower stage may be stopped when the dispensing motor 645 is driven in the reverse direction to drive the feed roller 440 and the like of the taking-in and taking-out mechanism 44 at the upper stage in the bill taking-out direction.

Figure 29:
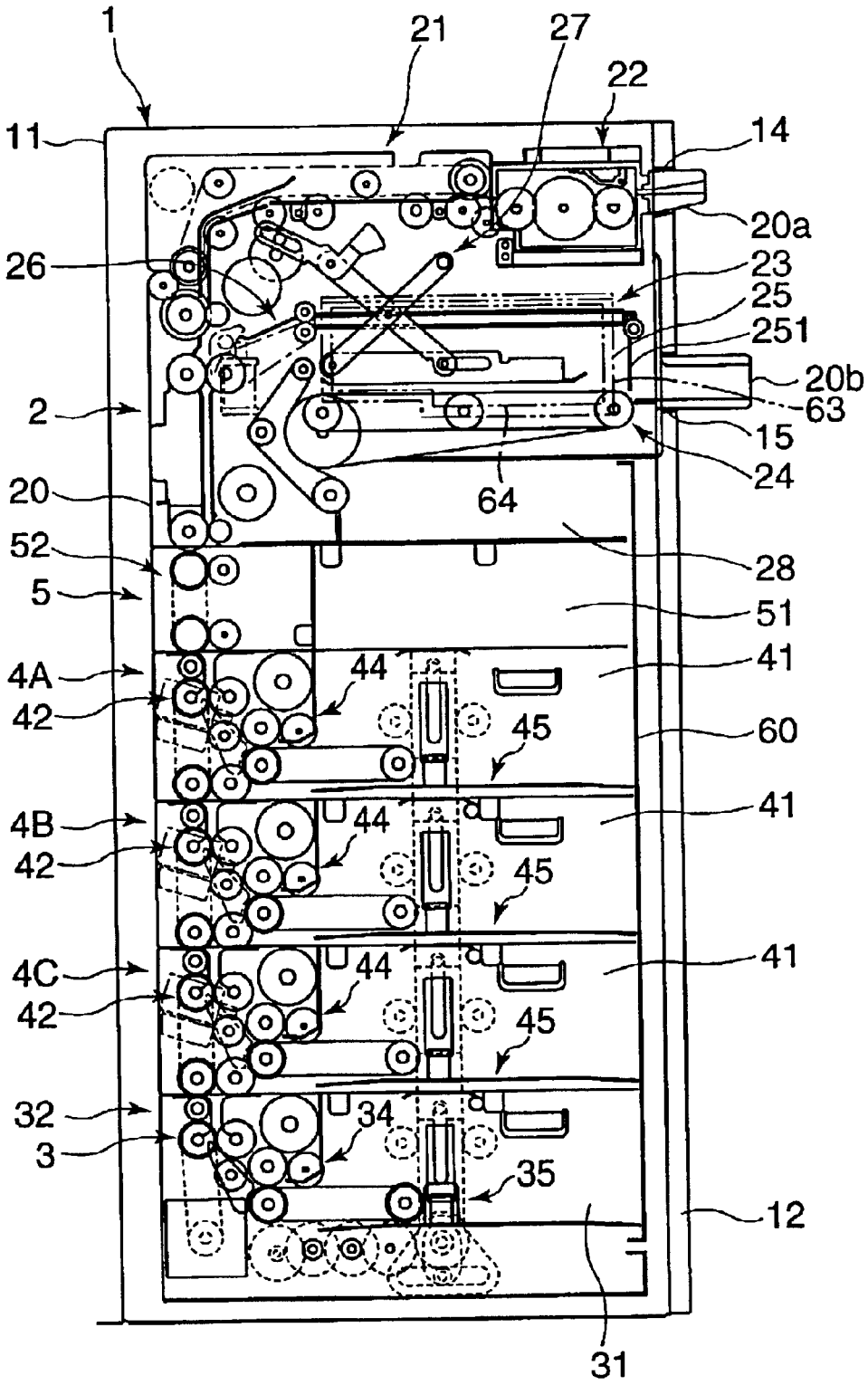
FIG. 29 is a schematic side view in longitudinal section of a bill handling apparatus according to still another embodiment.
Figure 30:
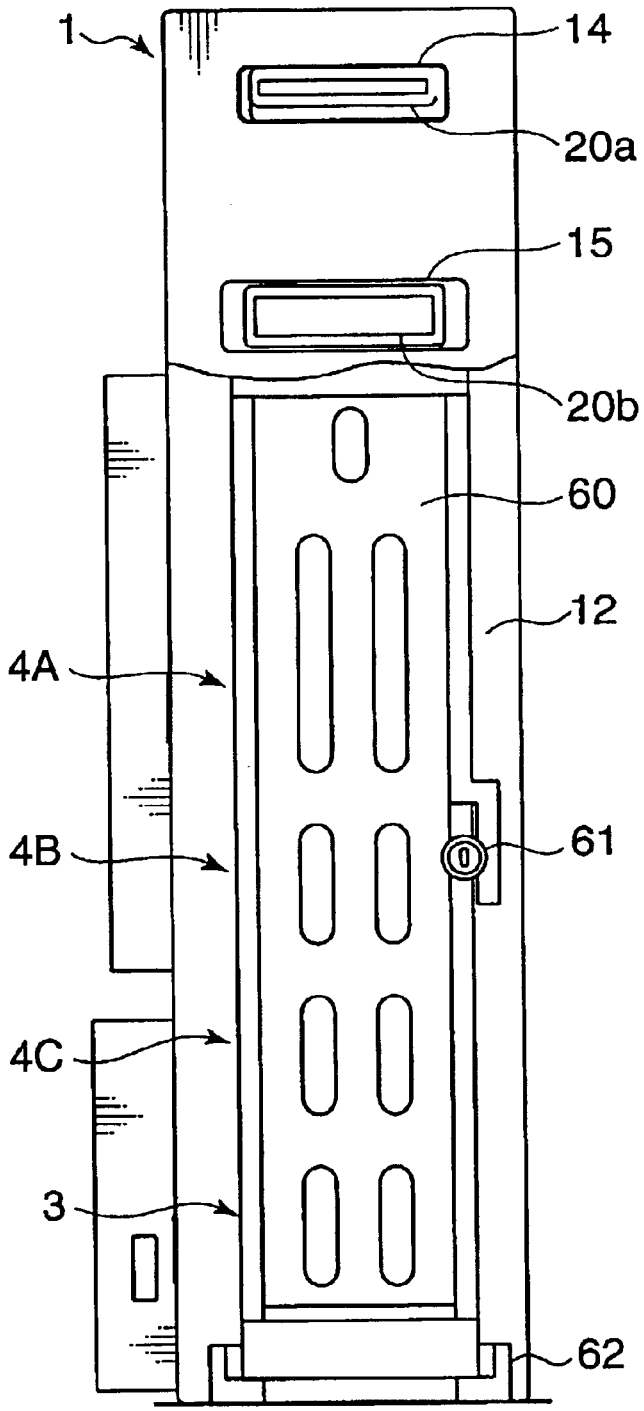
FIG. 30 is a schematic front view in longitudinal section of the bill handling apparatus of FIG. 29.

(2) Other Examples of the Combination of the Units and the Structure of the Door FIGS. 29 and 30 show another embodiment. In this embodiment, the deposit/withdrawal unit 2, the respective intermediate units 4A to 4C, the auxiliary unit 5 and the base unit 3 are coupled to each other; an internal construction formed by these units and the members belonging to these units is entirely withdrawal from the casing 1; and a door 60 for covering an entire range extending from the bottom part of the deposit/withdrawal unit 2 over to the other units is provided on the front side of the internal construction. In other words, this door 60 is a unitary assembly of the door 280 on the front surface of the rejection chamber 28 of the deposit/withdrawal unit 2, and the doors 310, 410 on the front surfaces of the other units of the foregoing embodiment and has one side thereof rotatably supported on the frames of the units. Identified by 61 is a lock for this door 60.

At the bottom of the casing 1 are provided a slide guiding mechanism 62 for slidably supporting the internal construction in inserting and withdrawing directions and a locking mechanism (not shown) for locking the internal construction while accommodating it in the casing 1.

On one side surface of the frame of the deposit/withdrawal unit 2, a window 64 provided with a door 63 for maintenance is provided at the side of the bill discharging mechanism 23, so that a jammed bill can be taken out through the window 64 by opening the door 63 in the case of jamming in the bill discharging mechanism 23.

According to this embodiment, in the case of maintenance, repair and the like, an operation such as maintenance can be easily done by withdrawing the internal construction forward from the casing 1 after opening the door of the casing 1 and unlocking the locking mechanism.

Further, in the case of taking the bills from the rejection chamber 28 and the respective bill storage sections 31, 41, the rejection chamber 28 and the respective bill storage sections 31, 41 are open forward by successively opening the door 12 of the casing 12 and the door 60 on the front surface of the internal construction, enabling the bills to be taken out.

In the case of taking the bills from the bill storage sections 31, 41, the pressing plates 353, 453 of the bill stacking mechanisms 35, 45 stand as a hindrance if being located at the lowered position. Thus, it is desirable to provide a pressing plate raising mechanism for automatically raising the pressing plates 353, 453 to a specified raised position when the door 60 is opened as described next.

(3) Pressing Plate Raising Mechanism

The pressing plate raising mechanism is described with reference to FIGS. 31 and 32.

Figure 31:
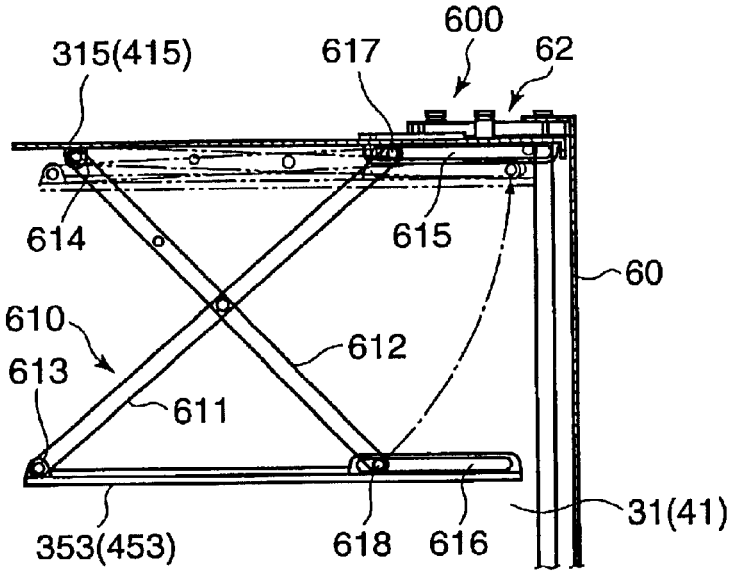
FIG. 31 is a plan view showing a pressing plate raising mechanism.
Figure 32:
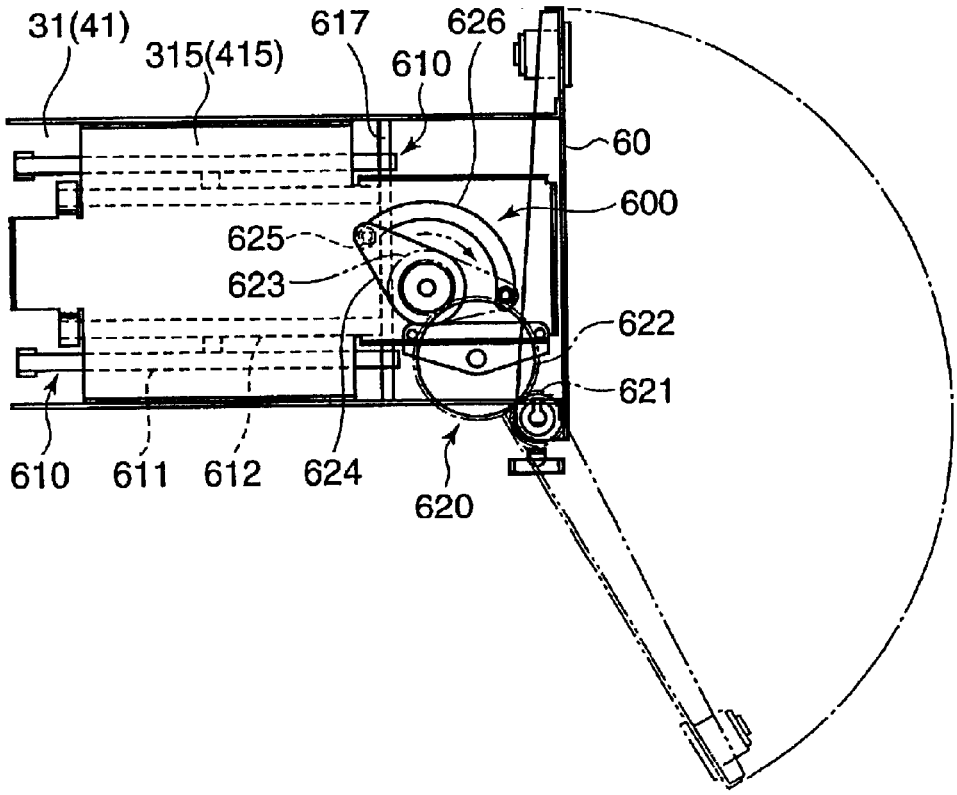
FIG. 32 is a side view showing the pressing plate raising mechanism.

As shown in FIGS. 31 and 32, the pressing plate raising mechanism 600 includes a movable portion which permits the pressing plate 353 (453) to be lowered to a position where it presses the bill when the door 60 is closed while raising the pressing plate 353 (453) up to a specified raised position when the door 60 is opened. Specifically, this movable portion is provided with link mechanisms 610 vertically extendible and contractible which are provided at the opposite sides inside the bill storage section, and a coupling mechanism 62 for coupling the door 60 and the link mechanisms 610.

Each link mechanism 610 includes a pair of links 611, 612 which cross in X-shape and are rotatably coupled to each other at their middle portions. The two links 611, 612 are located between a frame plate 315 (415) at the upper end of the bill storage section 31 (41) and the pressing plate 353, (453), ends of the links 611. 612 at one side (rear ends more distant from the door) are rotatably coupled to the pressing plate 353 (453) and the frame plate 315 (415) via pins 613, 614, whereas the other ends thereof (front ends closer to the door) are so coupled to oblong holes 615, 616 formed in the frame plate 315 (415) and the pressing plate 353 (453) and extending in forward and backward directions via bars 617, 618 as to be rotatable and movable within the extension of the oblong holes 616. 617.

Further, the coupling mechanism 620 is provided with a gear 621 mounted on a rotatable shaft of the door 60, an intermediate gear 622 in mesh with the gear 621, a gear 623 in mesh with the intermediate gear 622, and a lever 624 coaxially provided with the gear 623 and having a downward projecting portion 625 at its leading end. The projecting portion 625 of the lever 624 projects downward through an arcuate notch 626 formed in the frame plate 315 (415) and faces a position behind the bar 617. The rotatable shaft of the door 60 and the lever 624 are coupled via the gears 621, 622 and 623 so that the lever 624 is rotated forward when the door 60 is opened.

The pressing plate 353 (453) is biased downward by an unillustrated biasing means such as a spring.

The pressing plate raising mechanism 600 including the link mechanisms 610 and the coupling mechanism 620 is provided for each of the base unit 3 and the respective intermediate units 4A to 4C, and the gears 621 of the pressing plate raising mechanism 600 are mounted on the common rotatable shaft of the door 60 extending vertically along the entire length. In order to raise the pressing plate 453 of the intermediate unit 4A connected with the auxiliary unit 5 more than those of the other intermediate units 4A, 4B and the base unit 3 when the door is opened, the positional relationship between the projecting portion 625 of the lever 624 and the bar 617 is changed between the intermediate unit 4A and the other units to thereby adjust an elevation stroke of the link mechanism 610.

If the pressing plate raising mechanisms 600 are provided in this way, the pressing plates 353, 453 are raised in all of the base unit 3 and the intermediate units 4A to 4C when the door 60 is opened, and the bills can be easily taken out from any desired bill storage section.

In the foregoing embodiment in which the doors 310, 410 are individually provided for the respective bill storage sections 31, 41 of the base unit 3 and the intermediate units 4A to 4C, the pressing plate raising mechanisms 600 may be provided in the respective bill storage sections. In such a case, the pressing plate raising mechanisms 600 individually operate in the respective units when the doors 310 are opened.

(4) Another Example of the Bill Inserting Portion

Figure 33:
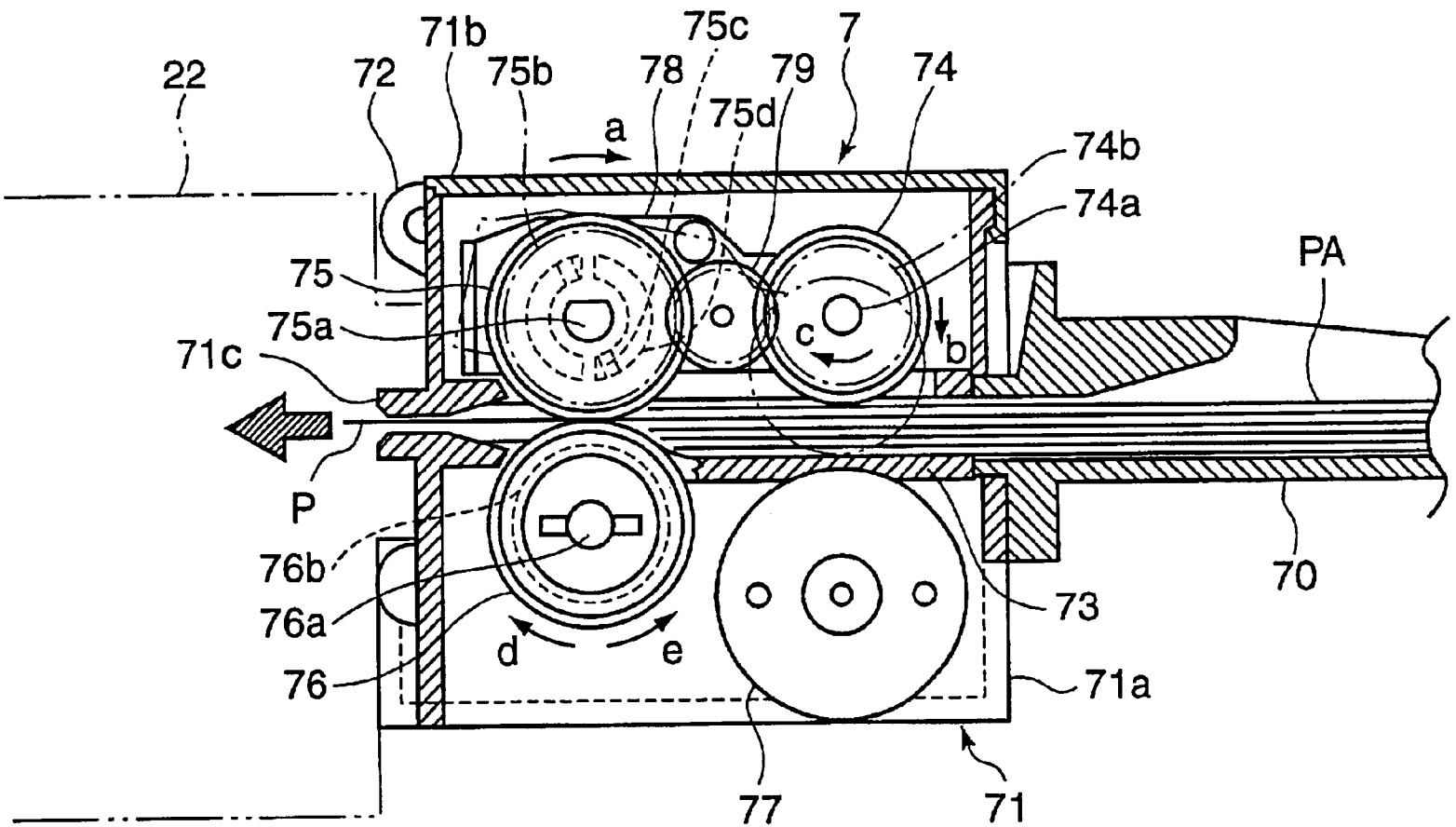
FIG. 33 is a section showing an essential portion when being provided with a bill batch taking-in device.
Figure 34:
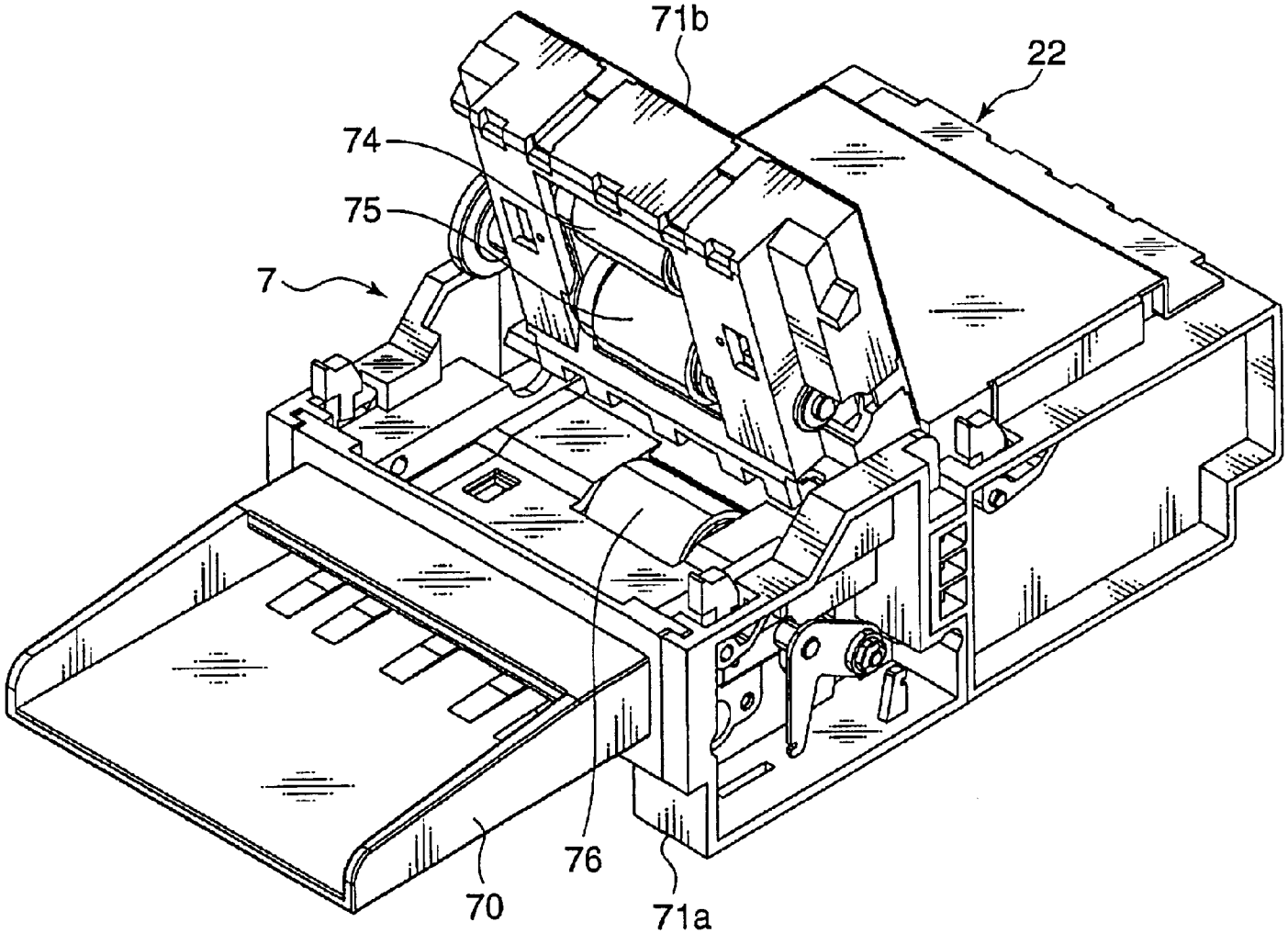
FIG. 34 is a perspective view of the bill batch taking-in device.

FIGS. 33 and 34 show another example of the bill inserting portion. In this example, a bill batch taking-in device 7 is detachably mounted on the deposit/withdrawal unit 2.

The bill batch taking-in device 7 has a box-shaped housing 71 comprised of a lower housing 71*a* and an upper housing 71*b* openably and closably coupled to the lower housing 71*a* via a hinge 72. A bill receptacle 70 is mounted on the front wall of the lower housing 71*a*, and stacked bills PA of a plurality of (e.g., about 20) bills are inserted into the housing 71 from the bill receptacle 70. Further, a bill send-out opening 71*c* for sending the separated bills to a downstream side is formed on the rear wall of the lower housing 71*b*.

Inside the housing 70 are provided a guide plate 73 for guiding the stacked bills PA, a bill take-in roller 74 positioned above the guide plate 73, a feed roller 75 located downstream from the roller 74 and forming a bill separator, a return roller 76 and a dispensing motor 77 as a driving source.

The bill take-in roller 74 is mounted on a take-in roller shaft 74*a* which is supported on a pivotal roller link 78, and is movable upward and downward as the roller link 78 is pivoted. Further, a roller gear 74*b* is mounted on the take-in roller shaft 74*a*.

The feed roller 75 is supported on a feed roller shaft 75*a* via a one-way clutch (not shown). This feed roller shaft 75*a* is coupled to the dispensing motor 77 via an unillustrated transmitter, and a feed roller gear 75*b* is mounted thereon. The feed roller 75 is rotatable with respect to the feed roller shaft 75*a* and is coupled in such a state where it is permitted to rotate by only a specified angle of rotation (range of an arcuate groove) with respect to the roller gear 75*b* by engaging a projection 75*c* provided on the feed roller 75 with an arcuate groove 75*d* formed in the feed roller gear 75*b*.

The feed roller gear 75*b* and the take-in roller gear 74*b* are coupled to each other via an idle gear 79.

The roller link 78 is coupled to the feed roller shaft 75*a* via a frictionally resisting member or the like so as to be biased in a direction to push the bill take-in roller 74 down as the feed roller shaft 75*a* is rotated in the bill taking-in direction (arrow a).

The return roller 76 is pressed against the feed roller 75 from below and is mounted on a return roller shaft 76*a* via a torque limiter 76*b*.

The bill batch taking-in device 7 is also provided with a bill sensor (not shown) for detecting the bills being inserted from the bill receptacle 70 into the housing 70.

The bill batch taking-in device 7 thus constructed is detachably mounted on the front surface of the housing of the discriminating device 22 incorporated into the bill introducing mechanism 21 by means of engagement, attachment or screws. For example, the front side of the discriminating device 22 is formed with a bill insertion opening portion enabling the engagement of a usual bill receiving member mounted when the bill batch taking-in device 7 is not mounted. Thus, the bill send-out opening 71*c* of the housing 71 is fitted into this opening portion and the housing 71 is fixed to the discriminating device 22 by means of, for example, screws. A supporting plate may be provided at a specified position in an inner upper part of the casing 1 and the discriminating device and the bill batch taking-in device 7 may be arranged side by side on this supporting plate.

With such an arrangement, when the stacked bills PA are inserted into the housing 71 from the bill receptacle 70 with the bill batch taking-in device 7 mounted on the deposit/withdrawal unit 2 inside the casing 1, they are detected by the bill sensor. In response to such a detection, the dispensing motor 77 of the bill batch taking-in device 7 and the motor 214 (see FIG. 1) of the bill introducing mechanism 21 are driven.

In the bill batch taking-in device 7, the feed roller shaft 75*a* and the feed roller gear 75*b* are rotated (arrow a) as the dispensing motor 22 is driven; the roller link 78 is pivoted downward to press the bill take-in roller 74 against the stacked bills PA (arrow b) as the feed roller shaft 75*a* is rotated; and the rotation of the feed roller 75*b* is transmitted to the take in roller gear 74*b* to rotate the bill take-in roller 74 (arrow c), thereby taking the stacked bills PA in.

Subsequently, the bill take-in roller 74 is rotated by a specified amount and the feed roller 75 starts rotating when the leading end of the stacked bills PA reaches the feed roller 75. When the first bill is taken in between the feed roller 75 and the return roller 76, the rotating force is transmitted from the feed roller 75 to the return roller 76 through the bill, whereby the return roller 76 is rotated together with the feed roller 75 (arrow d). When two or more bills are taken in, the return roller 76 is rotated in reverse direction (arrow e) by the action of the torque limiter 76*b* because a frictional force acting between the bills is smaller than a frictional force acting between the return roller 76 and the bill, whereby the second and successive bills are pushed back. In this way, the bills P are sent out one by one from the bill send-out opening 71*c*.

Although the dispensing motor 77 is provided in the bill batch taking-in device 7, it may be omitted. Instead, a transmitter including a gear and the like which is coupled when the bill batch taking-in device 7 is mounted on the deposit/withdrawal unit 2 may be provided between the bill introducing mechanism 21 and the bill batch taking-in device 7, so that the driving force of the motor 214 of the bill introducing mechanism 21 can be transmitted to the bill batch taking-in device 7. Such an arrangement enables the bill batch taking-in device to be smaller and lighter.

(Summary of the Features of the Present Invention)

The summary of the main features of the construction of the bill handling apparatus described above is as follows.

The inventive bill handling apparatus is, as described above, provided with the deposit/withdrawal unit and the base unit at the upper and lower sides and one or a plurality of intermediate units located between the deposit/withdrawal unit and the base unit inside the casing, wherein the deposit/withdrawal unit includes the bill introducing mechanism having the discriminating device for the bills, the bill discharging mechanism for discharging the bills to the discharge slot, and the conveying mechanism which can be driven in forward and reverse directions; the base unit includes the bill storage section, the conveying mechanism which can be driven in forward and reverse directions, and the taking-in and taking-out mechanism for the bills which can be driven in forward and reverse directions and is provided between the conveying mechanism and the bill storage section; and each intermediate unit includes the bill storage section, the conveying mechanism which can be driven in forward and reverse directions, the taking-in and taking-out mechanism for the bills which can be driven in forward and reverse directions and is provided between the conveying mechanism and the bill storage section, and the switcher for switching the bill moving direction between the conveying mechanism and the taking-in and taking-out mechanism.

In the inventive apparatus, preferably, the driving source for the conveying mechanisms is provided in the base unit; the driving force of the driving source is transmitted to the conveying mechanism of the base unit and also to the respective conveying mechanisms of the intermediate unit (s) and the deposit/withdrawal unit via the transmitter between the units; and the transmitter between the units are formed of the gears in mesh with each other between the units. With such an arrangement, the conveying mechanisms of the respective units can be driven by one driving source and the units can be easily combined and separated by using the gears as the transmitter between the units.

The driving portions of the taking-in and taking-out mechanisms are preferably individually provided in the base unit and the respective intermediate units. With such an arrangement, the operations of taking the bills into and out of the bill storage section can be individually controlled for the respective bill storage sections.

Further, the auxiliary unit is provided above one or more of the base unit and the intermediate units. This auxiliary unit preferably includes the storage space expanding portion in communication with the bill storage section of the unit located right below, and the conveying mechanism which can be driven in forward and reverse directions and is adapted to convey the bills in the range extending from the upper end to the bottom end of this unit behind the bill storage section. If the auxiliary unit is prepared, the storage space can be expanded for some bill storage section(s) expected to store a large number of bills.

Further preferably, the casing is provided with the control board unit and the power supply unit, which are electrically connected with the respective units via the detachable connectors. With such an arrangement, the electric systems can be easily connected and separated as the units are combined and separated.

If the respective units are individually withdrawable from the casing in the inventive apparatus, it is convenient for the maintenance of the respective units and repair, exchange and the like in the case that some unit(s) has/have a defect, a damage or the like. Alternatively, the entire internal construction comprised of the respective units may be withdrawal from the casing with these units connected with each other. Then, the construction can be even simpler.

INDUSTRIAL APPLICABILITY

According to the present invention, a plurality of kinds of bills can be deposited and withdrawn and can be stored according to the kinds of the bills and taken out from the respective bill storage sections. Further, the elements forming the bill storage section, the conveying mechanisms, and the like are made common, so that the bill storage sections can be easily increased and decreased by a necessary and minimum change.

What is claimed is:

1. A bill handling apparatus comprising a casing having openings formed at an upper part of a front surface thereof for insertion and discharge of bills therethrough, a deposit/withdrawal unit at a lower position in the casing and a base unit at a lower position in the casing, at least one intermediate unit located between the deposit/withdrawal unit and the base unit inside the casing and an auxiliary unit provided above at least the base unit, wherein:

the deposit/withdrawal unit includes a bill introducing mechanism having a discriminating device for discriminating bills and adapted to introduce the bills through an insertion slot communicating with one of the openings for receiving the bills, a bill discharging mechanism for discharging the bills to a discharge slot communicating with a second of the openings for discharging the bills, and a conveying mechanism that is drivable in forward and reverse directions, one end of the conveying mechanism being selectively positionable in communication with the bill introducing mechanism and the bill discharging mechanism via a switcher at a rear part of the deposit/withdrawal unit, an opposed end of the conveying mechanism being adapted to convey the bills along a bill conveyance path extending to a bottom end of the deposit/withdrawal unit;

the base unit includes a bill storage section, a conveying mechanism that is drivable in forward and reverse directions for conveying the bills within a specified range from an upper end of the base unit behind the bill storage section, and a taking-in and taking-out mechanism that is drivable in forward and reverse directions to take in and out the bills between the conveying mechanism and the bill storage section;

the at least one intermediate unit includes a bill storage section, a conveying mechanism that is drivable in forward and reverse directions to convey the bills within a range extending from an upper end to the bottom end of the at least one intermediate unit behind the bill storage section, a taking-in and taking-out mechanism that is drivable in forward and reverse directions to take in and out the bills between the conveying mechanism and the bill storage section, and a switcher for switching a bill moving direction between the conveying mechanism and the taking-in and taking-out mechanism; and the auxiliary unit includes a storage space expanding portion in communication with the bill storage section of the unit located right below, and a conveying mechanism that is drivable in forward and reverse directions and is adapted to convey the bills in a range extending from an upper end to a bottom end of the auxiliary unit behind the bill storage section.

2. A bill handling apparatus according to claim 1, wherein a driving source for the conveying mechanisms is provided in the base unit, and a transmitter is provided in the base unit, the at least one intermediate unit, the deposit/withdrawal unit and the auxiliary unit for transmitting a driving force of the driving source to the conveying mechanisms of the base unit, the at least one intermediate unit, the deposit/withdrawal unit and the auxiliary unit.

3. A bill handling apparatus according to claim 1, wherein driving sources for the taking-in and taking-out mechanisms are individually provided in the base unit and the at least one intermediate unit.

4. A bill handling apparatus according to claim 1, wherein the deposit/withdrawal unit, the base unit, the at least one intermediate unit and the auxiliary unit all are integrated with each other to be withdrawn from the casing when the deposit/withdrawal unit, the base unit, the at least one intermediate unit and the auxiliary unit are connected with each other.

5. A bill handling apparatus according to claim 1, wherein the casing includes a control board unit and a power supply unit, which are electrically connected with the respective units via detachable connectors.

6. A bill handling apparatus according to claim 1, wherein the respective units are individually withdrawable from the casing.

* * * * *